US006020681A

United States Patent [19]

Wang et al.

[11] Patent Number: 6,020,681

[45] Date of Patent: Feb. 1, 2000

[54] HIGH-DEFINITION CATHODE-RAY TUBE AND MANUFACTURING METHOD THEREOF

[75] Inventors: Ying-Fu Wang; Takashi Nishiguchi, both of Yokohama, Japan

[73] Assignee: Hitachi, Ltd., Tokyo, Japan

[21] Appl. No.: 08/862,714

[22] Filed: May 23, 1997

[30] Foreign Application Priority Data

May 29, 1996 [JP] Japan ..... 8-134874

[51] Int. Cl.[7] ..... H01J 29/10

[52] U.S. Cl. ..... 313/461; 313/463; 313/466; 430/24

[58] Field of Search ..... 313/461, 463, 313/466; 430/23, 24; 396/546, 547

[56] References Cited

U.S. PATENT DOCUMENTS

| | | | |
|---|---|---|---|
| 4,866,466 | 9/1989 | Van Der Waal | 354/1 |
| 5,398,192 | 3/1995 | Morohashi | 364/468 |
| 5,844,355 | 12/1998 | Wang et al. | 313/461 |
| 5,847,502 | 12/1998 | Uchida et al. | 313/414 |

FOREIGN PATENT DOCUMENTS

B-47-40983 of 0000 Japan .

*Primary Examiner*—Nimeshkumar D. Patel
*Assistant Examiner*—Michael J. Smith
*Attorney, Agent, or Firm*—Antonelli, Terry, Stout & Kraus, LLP

[57] ABSTRACT

A color cathode-ray tube, and a method for manufacturing this color cathode-ray tube capable of reducing light/dark line patterns produced while the color cathode-ray tube is operated. Exposing light which has passed through a correction lens made of a continuous lens and a discontinuous lens is irradiated onto a photosensitive film of an inner surface of a face panel of the color cathode-ray tube via a shadow mask so as to expose this photosensitive film, and then while using the exposed photosensitive film as a mask, fluorescent dot patterns are formed on a surface of the face panel. The correction lens having a discontinuous plane owns a plurality of light incident planes, a light projection plane for projecting the light entered into the light incident planes outside this light projection plane, and a plurality of level difference planes arranged between the light incident planes located adjacent to each other. The plural light incident planes are arranged in a matrix form, and enters therein light emitted from an exposing light source, and also refracts the entered light along a desirable direction. Then, the plural level difference planes are provided in such a manner that two sets of the light which have entered into two sets of the light incident planes located adjacent to the level difference plane are continuously projected from the light projection plane with being close to each other.

22 Claims, 15 Drawing Sheets

HIGH-DEFINITION CATHODE-RAY TUBE AND MANUFACTURING METHOD THEREOF

CROSS-REFERENCE TO RELATED APPLICATION

This application relates to an earlier filed application Ser. No. 08/676,341 now U.S. Pat. No. 5,844,152 filed on Jan. 20, 1995, the subject matter of which is incorporated by reference herein.

BACKGROUND OF THE INVENTION

The present invention generally relates to a color cathode-ray tube and a method for manufacturing the color cathode-ray tube. More specifically, the present invention is directed to provide such a color cathode-ray tube and a manufacturing method thereof capable of reducing light/dark line patterns produced while the color cathode-ray tube is operated.

Normally, a fluorescent screen is formed on an inner surface of a face panel of a color cathode-ray tube, and the fluorescent screen owns three color fluorescent layers made of three fluorescent layers on which a large number of dots, stripes and the like are formed and emit red, green, blue light. This fluorescent screen is manufactured by using the photographic printing method involving light exposing/developing steps. In other words, a photosensitive film is coated on the inner surface of the face panel, this coated photosensitive film is masked by way of a shadow mask, and then exposing light is irradiated onto the inner surface of the face panel. As a result, the exposing light which has passed through apertures (light passing holes) of the shadow mask may expose the photosensitive film to thereby form the above-described dots, stripes and the like.

On the other hand, paths of electron beams while a cathode-ray tube is operated are different from those of exposing light during an exposition operation. As a consequence, conventionally, in order to improve the beam landing characteristic, the following method has been introduced. That is, a correction lens is arranged in an exposure optical system, and exposing light is refracted by this correction lens in the exposing step, so that this exposing light is approximated to the actual orbit of the electron beams while the cathode-ray tube is operated.

The conventional method for forming the fluorescent film of the color cathode-ray tube with employment of this sort of correction lens is disclosed in, for instance, JP-A-47-40983 published in 1972. Referring now to drawings, the fluorescent film forming method of the color cathode-ray tube disclosed in JP-A-47-40983 will be explained.

FIG. 1 schematically represents a structure of a light exposure base used to manufacture a fluorescent film of a color cathode-ray tube according to the prior art.

Within the light exposure base 84 shown in FIG. 1, there are built the constructive elements such as a light exposing light source 81, a correction lens 82 having a continuous curved surface (will also be referred to as a "continuous lens" hereinafter), and another correction lens 83 having a discontinuous curved surface (will also be referred to as a "discontinuous lens" hereinafter) in this order from a bottom of this light exposure base 84. An opening portion 88 used to pass therethrough the exposing light emitted from the light exposing light source 81 is formed in an upper surface of the light exposure base 84. A face panel 85 on which a shadow mask 87 is mounted on the side of an inner surface thereof is mounted on the light exposure base 84. It should be noted that a photosensitive film 86 is coated on the inner surface of the face panel 85.

In the light exposure base 84 having the above-described arrangement, the exposing light projected from the exposing light source 81 is refracted by the continuous lens 82 and the discontinuous lens 83, and then passes through the apertures of the shadow mask 87 to reach the inner surface of the face panel 85, so that the photosensitive film 86 coated on the inner surface of the face 85 is exposed.

In this case, the discontinuous lens 83 provided inside the light exposure base 84 has such a function to refract the exposing light projected from the exposing light source 81, and also approximate the optical path of the exposing light to the orbit of the electron beams of the cathode-ray tube. As a consequence, the discontinuous lens 83 owns a very complex shape. FIG. 2 represents one example of the discontinuous lens 83. FIG. 2A is a front view for schematically showing this discontinuous lens, FIG. 2B is a sectional view for indicating the discontinuous lens shown in FIG. 2A, taken along a line A—A of FIG. 2A, and FIG. 2C is a sectional view for denoting the discontinuous lens shown in FIG. 2A, taken along a line B—B of FIG. 2A. As indicated in FIG. 2A to FIG. 2C, the discontinuous lens 83 is constructed in such a manner that a plurality of light incident surfaces 83*a* are arranged in a matrix form, and these light incident surfaces 83*a* own inclinations along a height (z) direction with respect to a horizontal (x) axis and a vertical (y) axis. Then, a level difference plane 83*b* is formed at a right angle to a light projection plane 83*c* at a boundary between the adjoining light incident surface 83*a*.

FIG. 3 is a perspective view for showing a mold used to form the discontinuous lens 83 shown in FIG. 2A to FIG. 2C. The mold used to form the conventional discontinuous lens is a so-called "assembled type mold", and as indicated in FIG. 3, is constituted by assembling a plurality of blocks 123 having planes 123*a* corresponding to the respective light incident (incoming) planes 83*a* of the discontinuous lens 83.

As previously described, in the above-explained discontinuous lens 83, the level difference plane 83*b* between the adjoining light incident planes 83*a* is provided at a right angle with respect to the light projection plane 83*c*. As indicated in FIG. 3, this is because a level difference 123*b* between the respective blocks is set perpendicular to a rear surface 123*c* of the mold in order that the respective blocks 123 for constituting the assembled type mold are assembled with each other without any space. The conventional discontinuous lens 83 owns the following problems since the level difference plane 83*b* is located at a right angle with respect to the light projection plane 83*c*.

FIG. 4 is a view for partially enlarging the discontinuous lens 83 shown in FIG. 2. The exposing light which is emitted from the exposing light source 81, passes through the continuous lens 82, and then is entered into the light incident (incoming) plane 83*a* of the discontinuous lens 83, is refracted at this light incident plane 83*a*. Thereafter, the refracted exposing light reaches the light projection (outgoing) plane 83*d* of the discontinuous lens 83. Then, this exposing light is refracted at the light projection plane 83 to be projected outside the lens, and is irradiated onto the inner surface of the face panel 85. However, the exposing light directed to a portion (portion "A" of FIG. 4) near the bottom of the light incident plane 83*a* will be entered into another portion (portion "B" of FIG. 4) near a summit portion of the adjoining light incident plane 83*a*. This exposing light entered into the portion near the summit portion is refracted at the light incident plane 83*a*, and thereafter would be refracted/reflected at the level difference plane 83*b* between the adjoining light incident planes 83*a*. As a consequence, the portion near the bottom portion of the light incident plane 83*a* could not be effectively utilized and such a region will be produced that the luminous flux density of the exposing light projected from the discontinuous lens 83 is lowered by a width "t" corresponding to a height of the level difference plane 83*b*. As a result such a portion is formed in the photosensitive film 86 coated on the inner surface of the face panel 85. That is, in this portion, the insufficient exposing process is carried out with the width "t" corresponding to the height of the level difference plane 83*b* of the discontinuous lens 83. This insufficient exposed portion will appear as the dark line pattern when the cathode-ray tube with employment of this face panel 85 is operated. As a result a shadow and a partially dropped display screen will be displayed, so that it is rather difficult to obtain a color cathode-ray tube with a high definition and a high image quality.

Also, since a plurality of blocks 123 having the planes 123*a* corresponding to the respective light incident planes 83*a* of the discontinuous lens 83 are assembled to each other so as to construct the mold for forming the above-explained discontinuous lens, there is a limitation when the area of the plane 123*a* and the height of the level difference 123*b* are made small, taking account of the precision and the like defined when the respective blocks 123 are combined with each other. As a consequence, it is difficult to reduce the area of the light incident plane 83*a* and also the height of the level difference plane 83*b* in the discontinuous lens 83 formed by using this mold. It is conceivable that the pitch of the light incident plane 83*a* is limited to on the order of 8 mm in the conventional discontinuous lens 83 formed by using the assembled type mold. This fact could not give a satisfactory solution as to needs for high-definition color cathode-ray tubes. That is, in this high-definition color cathode-ray tube, the screen which has been conventionally constituted by 400,000 pixels is tried to be constituted by pixels more than 1,000,000 pixels.

SUMMARY OF THE INVENTION

A major object of the present invention is to provide a color cathode-ray tube, and a method of manufacturing the same, capable of reducing light/dark line patterns produced while the color cathode-ray tube is operated.

Another object of the present invention is to reduce a landing error amount of a color cathode-ray tube.

To solve the above-described problems, a color cathode-ray tube, according to an aspect of the present invention, is featured in that more than 1,000,000 pixels of fluorescent dot patterns having a dot pitch smaller than, or equal to 0.3 mm are formed on a face panel; and when the fluorescent dot patterns are irradiated by electron beams, a landing error of the electron beams onto the fluorescent dot patterns is smaller than, or equal to 20 $\mu$m.

The fluorescent dot patterns are preferably formed by being exposed via a shadow mask while swinging at least one axis of a correction lens constituted by a plurality of flat planes, or a plurality of curved planes along X-axis and Y-axis directions.

In this case, the correction lens is comprised of a plurality of light incident planes arranged in a matrix form, for entering therein light emitted from an exposing light source and for refracting the entered light along a desirable direction; a light projection plane for projecting the light entered into the light incident planes outside this light projection plane; and a plurality of level difference planes arranged between the light incident planes located adjacent to each other, and then the level difference plane is preferably provided in such a manner that two sets of light which have entered into two sets of these light incident planes located adjacent to this level difference plane are projected from the light projection plane with being close to each other.

Also, the correction lens is comprised of a plurality of light incident planes arranged in a matrix form, for entering therein light emitted from an exposing light source and for refracting the entered light along a desirable direction; a light projection plane for projecting the light entered into the light incident planes outside this light projection plane; and a plurality of level difference planes arranged between the light incident planes located adjacent to each other, and then respective level difference planes are alternatively provided in such a manner that the respective light which are entered into each of the two light incident planes located adjacent to each of the level difference planes are projected from the light projection plane with having a Constance interval.

Furthermore, the correction lens is comprised of a plurality of light incident planes arranged in a matrix form, for entering therein light emitted from an exposing light source and for refracting the entered light along a desirable direction; a light projection plane for projecting the light entered into the light incident planes outside this light projection plane; and a plurality of level difference planes arranged between the light incident planes located adjacent to each other, and then at least one of the plurality of light incident planes may be formed in such a manner that a summit portion formed by this one light incident plane and the level difference plane located adjacent to this light incident plane owns the same height as a summit portion of the light incident planes located adjacent to this light incident plane via the level difference plane.

Also, a method for manufacturing a color cathode-ray tube, according to another aspect of the present invention, is featured in that while swinging a correction lens formed in such a manner that a level distance is made smaller than, or equal to 5 $\mu$m, which is constituted by a plurality of flat planes, or a plurality of curved planes, and is defined between the flat planes, or the curved planes located adjacent to each other, exposing light which has passed the correction lens is irradiated onto a photosensitive film formed on an inner surface of a face panel of the color cathode-tube via a shadow mask so as to expose the photosensitive film; and while using the exposed photosensitive film as a mask, fluorescent dot patterns are formed on a surface of the face panel, whereby a screen is constituted by more than 1,000,000 pieces of elements made of the fluorescent dot patterns, and a landing error onto the fluorescent dot patterns is lower than, or equal to 20 $\mu$m.

More specifically, light is emitted from an exposing light source; a correction lens is swung in asynchronous mode along a longitudinal direction, and a transverse direction; and this correction lens is comprised of a plurality of light incident planes arranged in a matrix form, for entering therein light emitted from an exposing light source and for refracting the entered light along a desirable direction; a light projection plane for projecting the light entered into the light incident planes outside this light projection plane; and level difference planes arranged between the light incident planes located adjacent to each other, in such a manner that a plurality of the light entered into the light incident planes located adjacent to each other are projected from the light projection plane with being close to each other; whereby the light emitted from the exposing light source is refracted.

The light refracted by the correction lens is irradiated onto an inner surface of a face panel provided with a shadow mask so as to expose a photosensitive film coated on the inner surface of the face panel.

Alternatively, the light is emitted from the exposing light source;

the light projected from the exposing light source is refracted by employing a correction lens for projecting the incident light toward a desirable direction with having a constant interval, while swinging this correction lens in an asynchronous mode along a longitudinal direction and along a transverse direction; and the light which has been refracted by the swung correction lens is irradiated onto the inner surface of the face panel on which the shadow-mask has been formed, so that the photosensitive film coated on the inner surface of the face panel is exposed.

BRIEF DESCRIPTION OF THE DRAWINGS

Preferred embodiments of the present invention will now be described in conjunction with the accompanying drawings, in which.

DESCRIPTION OF THE PREFERRED EMBODIMENTS

Referring now to drawings, a color cathode-ray tube according to a first embodiment of the present invention will be described.

Figure 5:
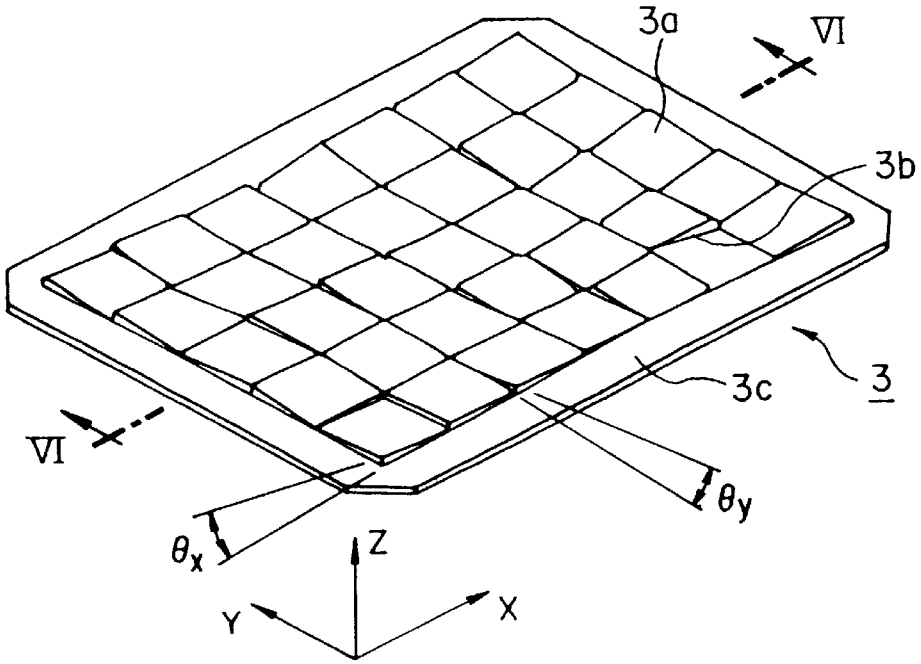
FIG. 5 is a perspective view for schematically indicating a discontinues lens employed in a color cathode-ray tube according to a first embodiment of the present invention.
Figure 6:
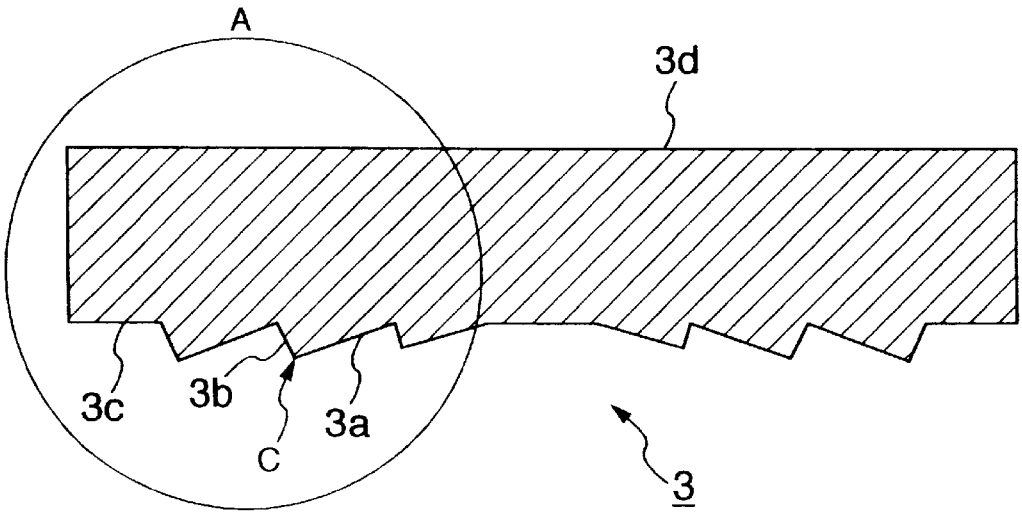
FIG. 6 is a sectional view for schematically showing the discontinuous lens of FIG. 5, taken along an arrow VI—VI of FIG. 5.

FIG. 5 is a perspective view for schematically showing a discontinuous lens 3 used to manufacture a color cathode-ray tube according to a first embodiment of the present invention. FIG. 6 is a sectional view for schematically representing the discontinuous lens 3 indicated in FIG. 5, taken along an arrow direction of VI—VI. For the sake of clear explanations of the present invention, it should be understood that the discontinuous lenses 3 shown in FIG. 5 and FIG. 6 are directed opposite to each other in the upper/lower direction.

The discontinuous lens 3 for constructing a correction lens, indicated in FIG. 5 and FIG. 6, is employed so as to achieve such a purpose. That is, exposing light is refracted in a light exposure step for forming a fluorescent film of the color cathode-ray tube, so that an optical path of this exposing light is approximated to orbit of electron beams of the color cathode-ray tube. This discontinuous lens 3 may be installed in the light exposure base 84 shown in FIG. 1, as previously explained in the prior art, and also in a light exposure base indicated in FIG. 16 (will be explained later).

The discontinuous lens 3 is manufactured from optical plastic such as polymethyl metaacrylate having a high light transmissivity, and thermosetting resin. As indicated in FIG. 5 and FIG. 6, a plurality of light incident (incoming) planes 3*a* arranged in a matrix shape, a plurality of level difference planes 3*b* provided between the adjoining light incident planes 3*a*, and a reference plane 3*c* are formed on a surface of this discontinuous lens 3.

A plurality of light incident planes 3*a* own various inclinations, or gradients along a height (Z) direction with respect to a horizontal (X) axis and a vertical (Y) axis. In FIG. 5, while both the X axis and the Y axis are defined on the reference plane 3*c*, the inclination of the light incident plane 3*a* along the Z direction with respect to the X axis is expressed as "θx", and the inclination of this light incident plane 3*a* along the Z direction with respect to the Y axis is expressed as "θy". Each of these light incident planes 3*a* is formed in a preselected curvature and with predetermined inclinations of "θx" and "θy" in such a manner that when the discontinuous lens 3 is set to the light exposure base shown in FIG. 1, the exposing light which is emitted from an exposing light source installed in this light exposure base and then is entered into this light incident plane 3*a* may be projected from a light projection (outgoing) plane 3*d* along a predetermined direction. In other words, the exposing light is irradiated into a predetermined position on an inner surface of a face panel located in the light exposure base.

Figure 1:
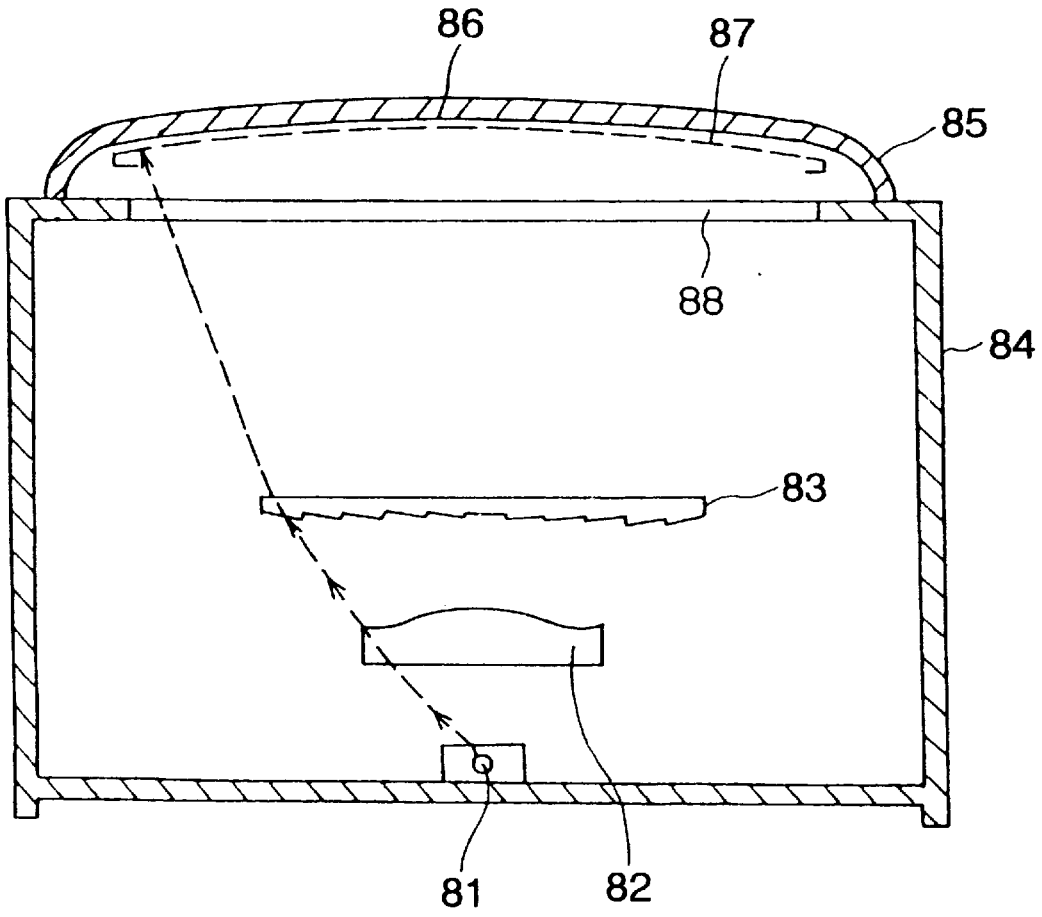
FIG.1 PRIOR ART
FIG. 1 is a schematic structural diagram for showing the light exposure base for forming the conventional face panel fluorescent film.

A plurality of level difference planes 3*b* are formed in such a manner that when the discontinuous lens 3 is installed in the light exposure base as shown in FIG. 1, this level difference plane is located in parallel to an optical path of exposing light which passes through a boundary (for example, a portion "C" indicated in FIG. 6) between the level difference plane 3*b* and the light incident plane 3*a* connected to this level difference plane 3*b*. The heights of the respective level difference plane 3*b* are calculated based upon the inclinations θx and θy of each of the light incident planes 3*a*, and thicknesses (maximum thickness and minimum thickness) of the discontinuous lens 3.

Next, a description will now be made of an optical path of exposing light in the vicinity of the discontinuous lens 3 in such a case that the discontinuous lens 3 is installed in the light exposure base 84 shown in FIG. 1 and the photosensitive film formed on the inner surface of the face panel.

Figure 7:
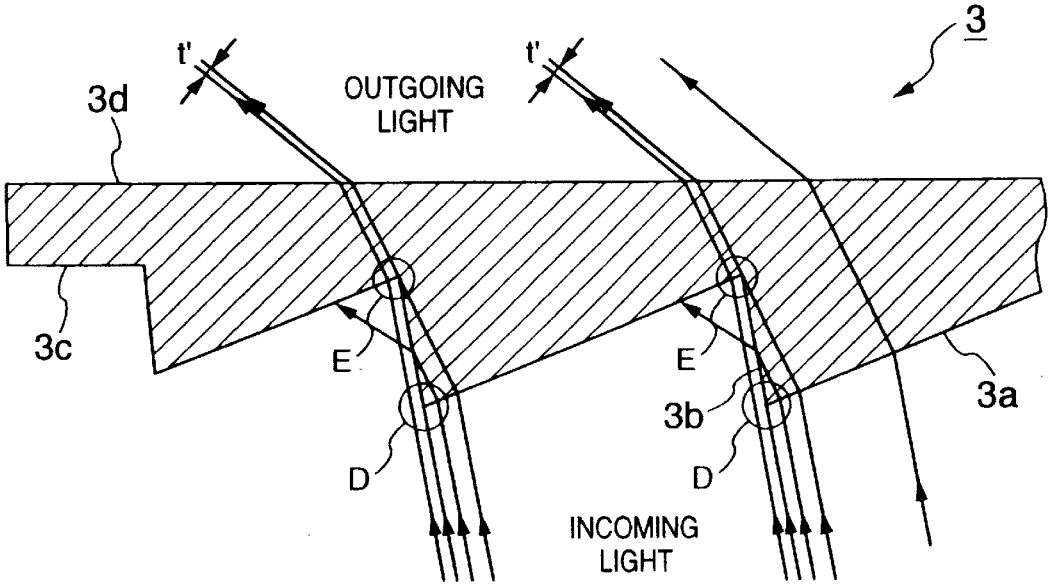
FIG. 7 is a view for partially enlarging the discontinuous lens shown in FIG. 6.

FIG. 7 is an enlarged view for representing a portion "A" of the discontinuous lens 3 shown in FIG. 6. When the discontinuous lens 3 is installed in the light exposure base shown in FIG. 1 and the photosensitive film formed on the inner surface of the face panel is exposed, the exposing light which is emitted from the exposing light source, passes through the continuous lens, and then is entered into the photosensitive film formed on the inner surface of the face panel, is refracted on a light incident (incoming) plane 83*a*, and thereafter reaches the light projection (outgoing) plane 3*d* of the discontinuous lens 3. Then, this exposing light is refracted at the light projection place 3*d* to be projected out from the discontinuous lens 3, and then is irradiated onto the inner surface of the face plate. In this case, the exposing light entered near the summit portion of the light incident plane 3*a* is refracted at the light incident plane 3*a*, and thereafter would be refracted/reflected at the level difference plane 3*b* between the adjoining light incident plane 3*a*. However, as shown in FIG. 7, in this discontinuous lens 3, the respective level difference planes 3*b* are formed in such a manner that these level difference planes 3*b* are positioned in parallel to the optical path of the exposing light passing through a boundary (namely, a portion "D" of FIG. 7) between the level difference plane 3*b* and the light incident plane 3*a* connected to this level difference plane 3*b*. As a result, the exposing light directed to a portion (namely, a portion "E" of FIG. 7) in the vicinity of a bottom portion of the light incident plane 3*a* may directly reach near the bottom portion of this light incident plane 3*a* without being interrupted at a portion (namely, a portion "D" of FIG. 7) in the vicinity of the summit portion of the adjoining light incident plane 3*a*. As a consequence, the portion near the bottom portion of the light incident plane 3*a* can be effectively utilized, and it is possible to prevent a region whose luminous flux density is low in a width "t" from being produced in the exposing light projected from the discontinuous lens 3. This width "t" corresponds to a height of the level difference plane 3*b*. Accordingly, since it is possible to avoid such a fact that an insufficiently exposed portion having a width corresponding to a height "t" of the level difference plane 3*b* of the discontinuous lens 3 is formed in the photosensitive film coated on the inner surface of the face panel, a high-definition color cathode-ray tube with a high image quality can be manufactured by exposing the photosensitive film formed on the inner surface of the face panel by employing the discontinuous lens 3.

It should be understood that in the above description, the respective level difference planes 3*b* are made to become parallel to the optical path of the exposing light which passes through the boundary between the level difference plane 3*b* and the light incident plane 3*a* connected to this level difference plane 3*b* in the discontinuous lens 3. Alternatively, each of these level difference planes 3*b* may be provided in such a manner that the exposing light entered into one of the light incident planes 3*a* located adjacent to this level difference plane 3*b*, and also the exposing light entered into the other of these light incident planes 3*a* may be projected from the light projection plane 3*d* without making an interval therebetween.

Figure 8:
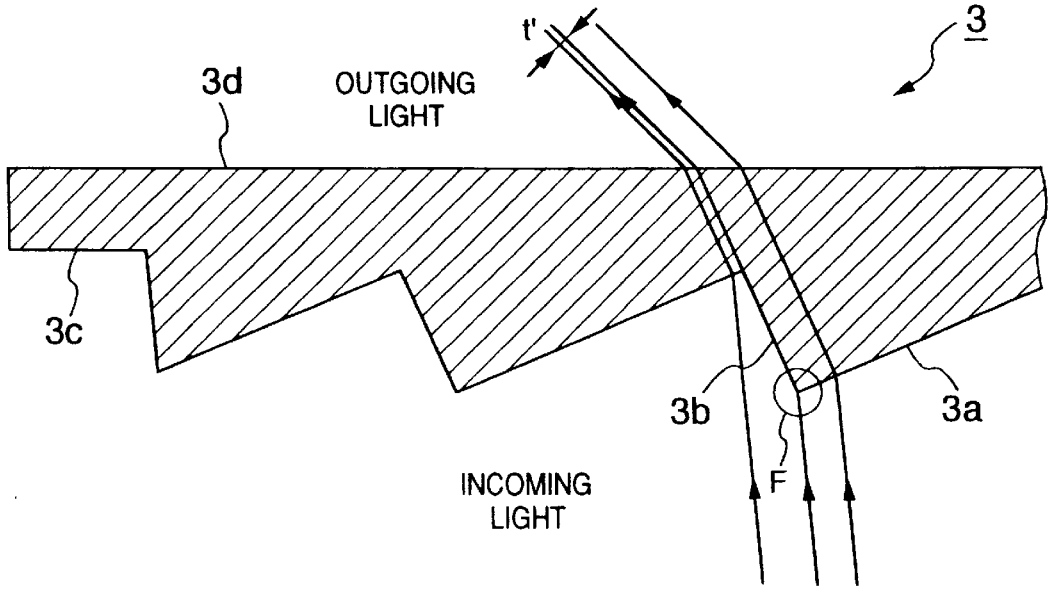
FIG. 8 is a diagram for explaining a modification of the discontinuous lens indicated in FIG. 5, corresponding to that of FIG. 7.

For example, as indicated in FIG. 8, each of these level difference planes 3*b* may be formed to become parallel to an optical path of the exposing light inside the discontinuous lens 3, which is entered into a portion (namely, a portion "F" of FIG. 8) in the vicinity of the summit portion of the light incident plane 3*a* connected to this level difference plane 3*b*. Also, in this alternative case, the portion near the bottom portion of the light incident plane 3*a* can be effectively utilized, and it is possible to avoid such a problem that the region whose luminous flux density is low and having the width "t" corresponding to the height of the level difference plane 3*b* is formed in the exposing light projected from the discontinuous lens 3.

Figure 9A:
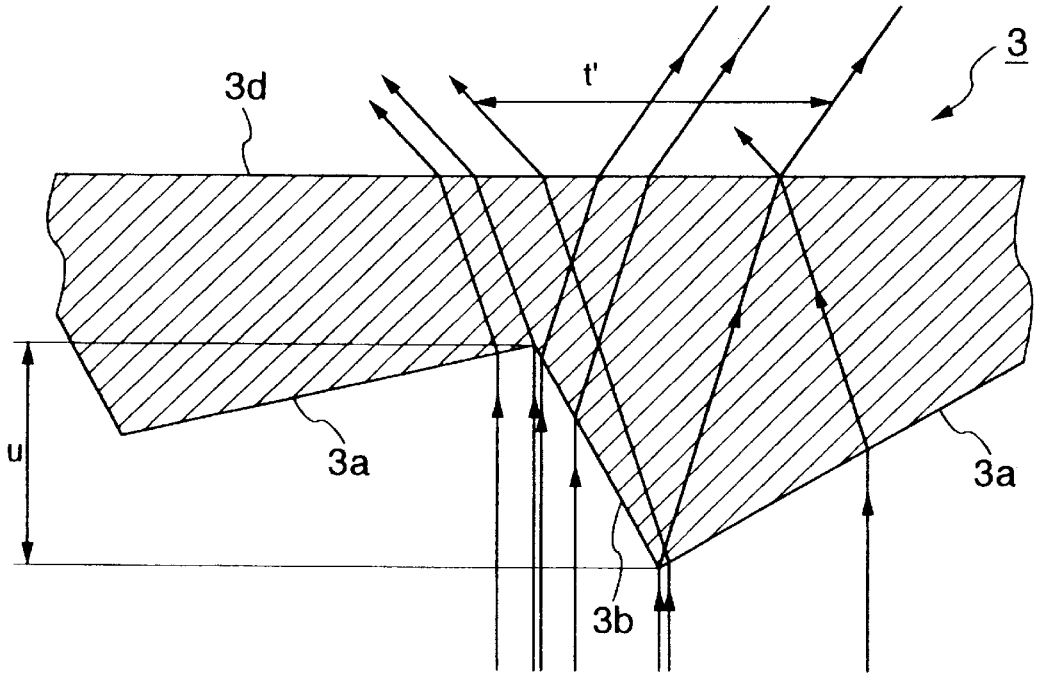
FIGS. 9A and 9B are diagrams for explaining another modification of the discontinuous lens indicated in FIG. 5, corresponding to that of FIG. 7.
Figure 9B:
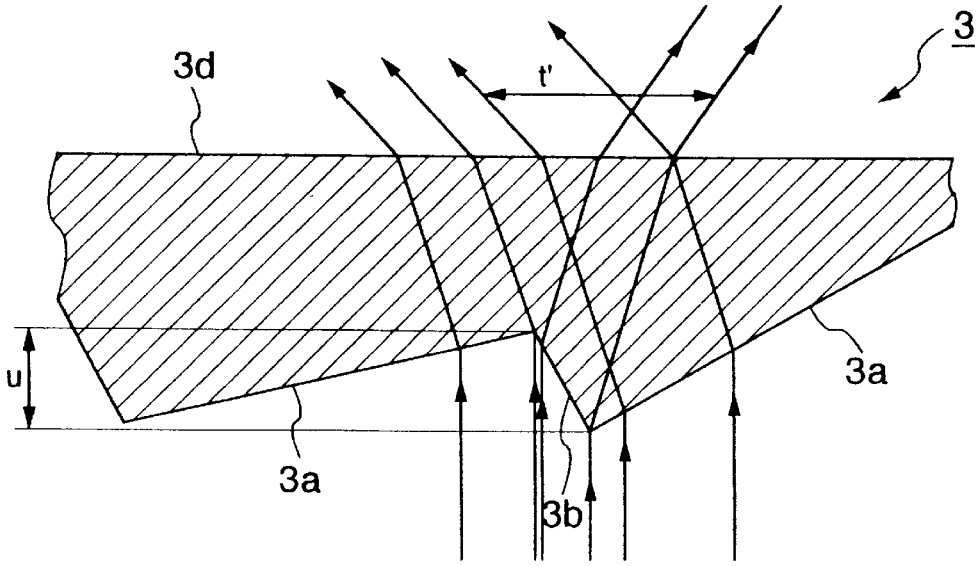

Also, in the case that a height "u" of the level difference plane 3*b* becomes larger than, or equal to a preselected value, as shown in FIG. 9A, the forming position of the light incident plane 3*a* may be changed in such a way that positions of summit portions of two light incident surfaces located adjacent to each other via this level difference plane 3*b* are located on the same plane, as indicated in FIG. 9B. When the height "u" of the level difference plane 3*b* is large, if this level difference plane 3*b* is formed to become parallel to the optical path of the exposing light, then the positions of the two light incident planes 3*a* located adjacent to each other via this level difference plane 3*b* are separated from each other. In other words, a ratio of the level difference plane 3*b* to the entire surface of the discontinuous lens 3 is increased, so that a ratio of the light incident plane 3*a* to the overall surface of this discontinuous lens 3 is decreased. This implies that the utilization efficiency of the surface of the discontinuous lens 3 would be accordingly lowered. In such a case, as illustrated in FIG. 9B, the positions of the summit portions of the two light incident planes 3*a* located adjacent to each other via this level difference plane 3*b* are made coincident with each other in order to reduce the height "u" of this level difference plane 3*b*, so that the utilization efficiency of the surface of the discontinuous lens can be improved.

Subsequently, a method for manufacturing the discontinuous lens 3 will now be explained.

Figure 10:
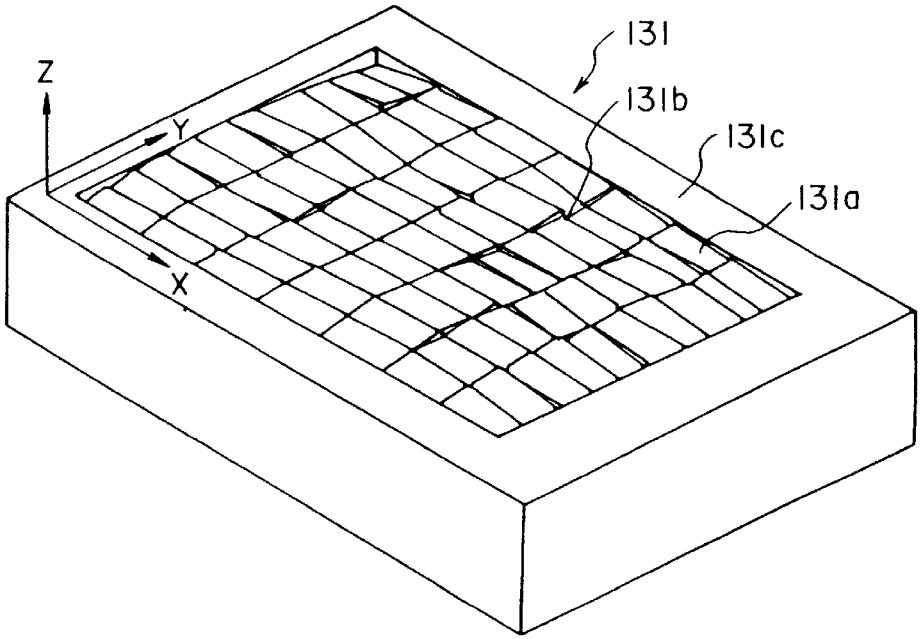
FIG. 10 is a perspective view for schematically showing a mold used to form the discontinuous lens indicated in FIG. 5.

FIG. 10 is a perspective view for schematically showing a mold used to form the discontinuous lens 3.

As indicated in FIG. 10, the discontinuous lens 3 is manufactured in such a manner that a lens material such as optical plastic, e.g., polymethyl metaacrylate having a high light transmissivity, and thermosetting resin is supplied to a surface of a mold 131 on which planes 131*a*, 131*b*, 131*c* have been formed in correspondence with the light incident plane 3*a*, the level difference plane 3*b*, and the reference plane 3*c* of the discontinuous lens 3, and then this lens material is heated and compressed. It should also be noted that even when ultraviolet thermoplastic resin is supplied to the surface of the mold 131, and ultraviolet rays are irradiated onto the mold 131 while giving pressure to this ultraviolet thermoplastic resin, the discontinuous lens 3 may be manufactured. As the materials of the mold 131 used to form the discontinuous lens 3, non-iron soft metals may be suitably employed, for example, an aluminum alloy, brass, and copper.

Next, a description will now be made of a cutting process (work) method of the mold shown in FIG. 10.

Figure 11:
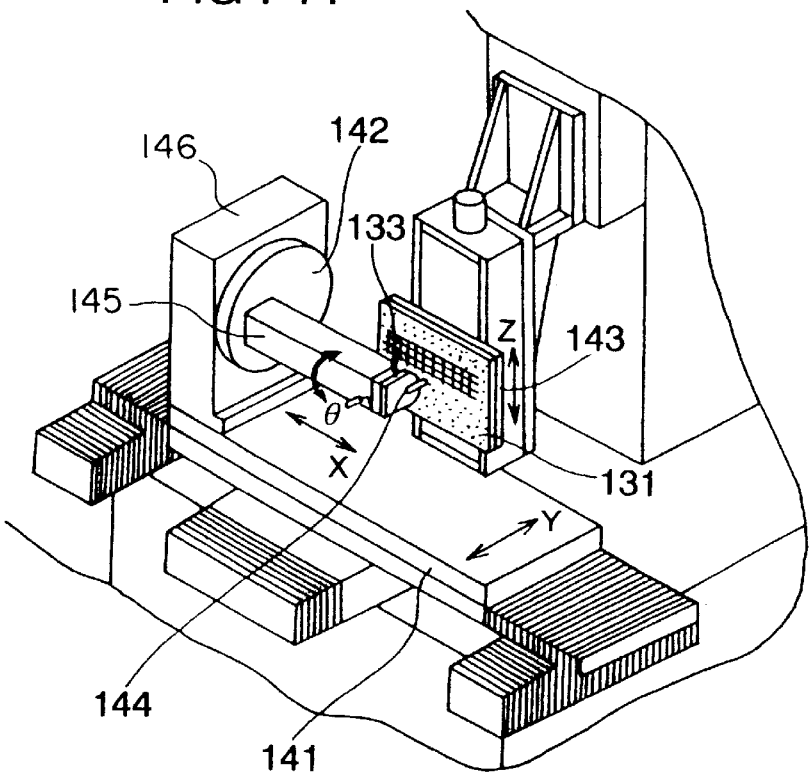
FIG. 11 illustrates a cutting work machine for the mold shown in FIG. 10.

FIG. 11 is a perspective view for partially showing a cutting process (work) apparatus of the mold shown in FIG. 10.

The cutting process apparatus indicated in FIG. 11 is arranged by an X–Y stage 141, a diamond cutting tool 144 corresponding to a cutting tool, a polishing/cutting main shaft 145 for holding the diamond cutting tool, a rotary table 142 on which the polishing/cutting main shaft 145 is mounted, a Z-table 143, and a CNC (Computer Numerical Control) control apparatus (not shown).

The rotary table 142 is pivoted in response to a command (instruction) issued from the CNC control apparatus. As a result, an angle of the diamond cutting tool 144 is adjusted. The rotary table 142 is provided on a base 146 installed on the X–Y stage 141.

The X–Y stage 141 is transported along an X-axis direction and a Y-axis direction in response to a command (instruction) issued from the CNC control apparatus. As a result, the positions of the diamond cutting tool 144 along the X-axis direction and the Y-axis direction are adjusted.

A work 133 corresponding to a mold material is fixed on the Z-table 143. The Z-table 143 adjusts the position of the work 133 along the Z-axis direction in response to a command (instruction) issued from the CNC control apparatus.

The CNC control apparatus (not shown) controls the operations of the X–Y stage 141, the Z-table 143, and the rotary table 142 in accordance with an NC (Numerical Control) program stored in a memory employed in this CNC control apparatus.

The cutting process apparatus shown in FIG. 11 executes the cutting process of the planes (namely, planes 131*a*, 131*b*, 131*c* of FIG. 10) corresponding to the surface shape of the discontinuous lens 3 over the surface of the work 133 by using the diamond cutting tool 144 while controlling the operations of the X–Y stage 141, the Z-table 143, and the rotary table 142 based on the NC program.

This stage process apparatus cuts the surface of the work 133 by transporting the X–Y stage 141 along the Y-axis direction, and cuts/feeds the surface of the work 133 by continuously transporting the X–Y stage 141 along the X-axis direction. Then, when the cutting process for 1 column is accomplished, the cutting process apparatus transports the Z-table 143 along the Z-axis direction to thereby perform the cutting process for the next column.

Next, a cutting process executed by cutting process apparatus indicated in FIG. 11 will now be explained.

Figure 12:
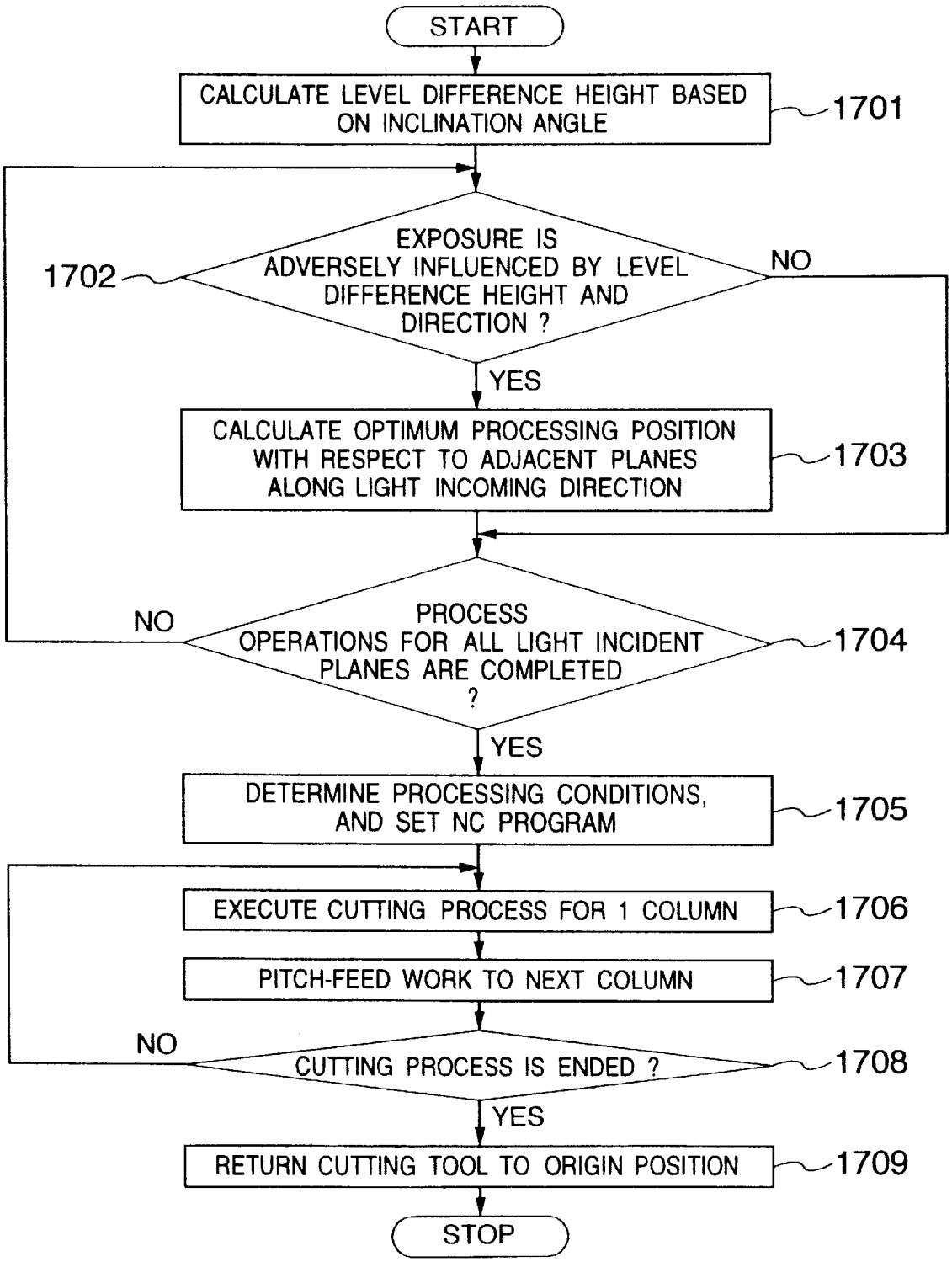
FIG. 12 is a flow chart for explaining a cutting work process operation of the cutting work machine shown in FIG. 11.

FIG. 12 is a flow chart for describing the cutting process executed by the cutting process apparatus shown in FIG. 11.

Figure 2B:
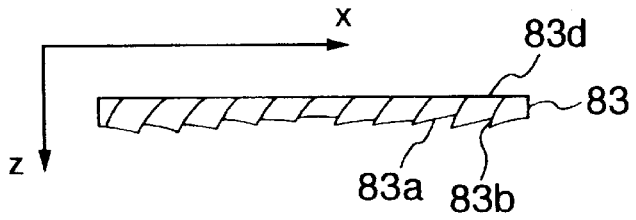
FIG. 2B PRIOR ART
FIG. 2A to 2C are schematic diagrams for representing the conventional discontinuous lens.
Figure 2A:
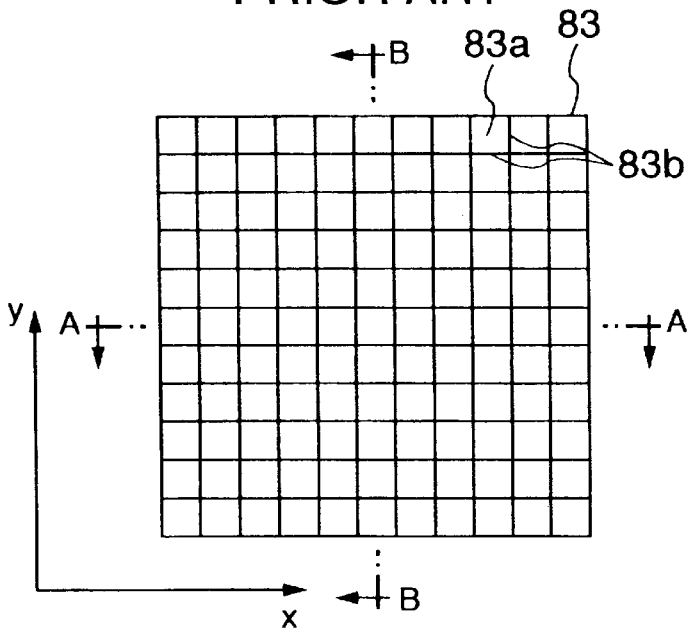
FIG. 2A PRIOR ART
Figure 2C:
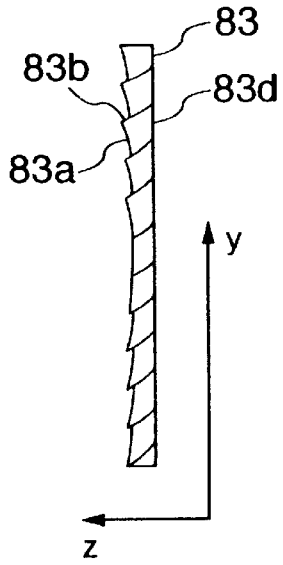
FIG. 2C PRIOR ART

First, a calculation is made of a curvature, and inclinations (tilts) "θx", "θy" of each of the light incident planes 3*a*, and further of a height of each of the level difference planes 3*b*, which are formed in the discontinuous lens 3 (step 1701). As previously described, the curvature and the inclinations θx, θy of each of the light incident planes 3*a* are set in such a manner that when the discontinuous lens 3 is installed in the light exposure base as shown in FIG. 1, the exposing light which is emitted from the exposing light source set in this light exposure base and then is entered into this light incident plane 3*a* may be projected from the light projection plane 3*d* along a preselected direction, namely, this exposing light is irradiated onto a predetermined position on the inner surface of the face panel positioned on the light exposure base. Also, the height of each of the level difference planes 3*b* is calculated based upon the inclinations θx, θy of each of the light incident planes 3*a*, and also thicknesses (maximum thickness and minimum thickness) of the discontinuous lens 3. It should be understood that the respective level difference planes 3*b* are set at a right angle with respect to the light projection planes in a similar manner to the level difference planes 83*b* of the discontinuous lens 83 shown in FIG. 2, as previously explained in the prior art.

Figure 13:
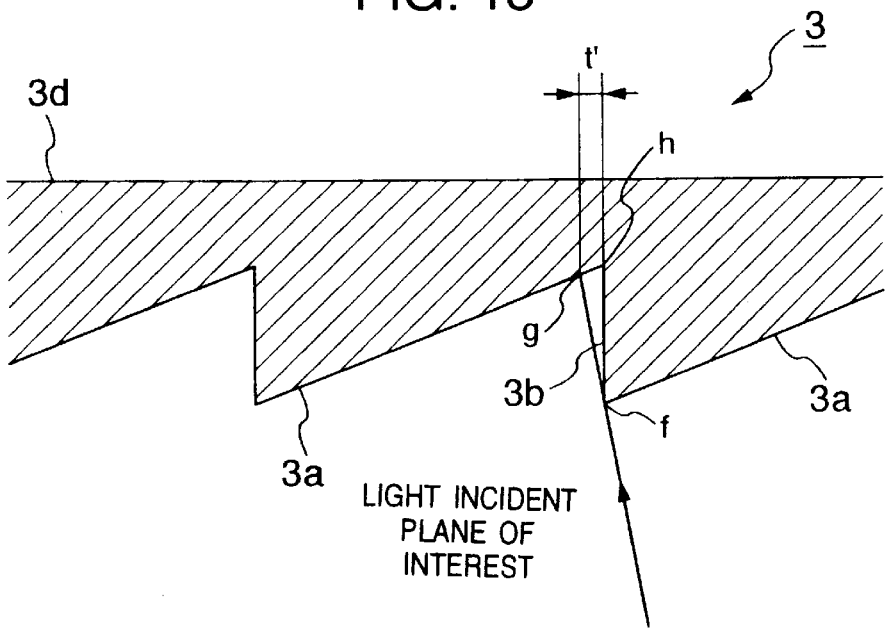
FIG. 13 is a diagram for explaining the judgment executed at the step 1702 of FIG. 12, corresponding to that of FIG. 7.

Next, as to one light incident plane 3*a*, a dimension (width) of such a region is predicted, and a judgment is made as to whether or not this region gives an adverse influence to the exposure of the photosensitive film formed on the inner surface of the face panel (step 1702). In this region, the exposing light does not directly reach, but it cannot be effectively utilized. This judgment is carried out in accordance with the following procedure. FIG. 13 is an explanatory diagram for explaining the judgment executed at the step 1702, namely an enlarged view for partially showing the discontinuous lens 3 under the condition set at the step 1701.

First, an incident angle of the exposing light to each of the light incident planes 3*a* is predicted in such a case that the discontinuous lens 3 is installed in the light exposure base as shown in FIG. 1 under the condition defined at the step 1701. This prediction may be performed by considering the light projection (outgoing) angle of the exposing light from the exposing light source, and also the refraction of the exposing light at the continuous lens.

Next, as shown in FIG. 13, a position "f" of a summit portion of a light incident plane 3*a* is calculated to predict a position "g" where the exposing light passing through the summit portion position "f" reaches, and this light incident plane 3*a* is located adjacent to a bottom portion of a light incident plane 3*a* of interest. Then, a calculation is made of a distance "t'", defined from the bottom portion position "h" of the light incident plane 3*a* of interest to the position "g" where the exposing light passing through the summit portion position "f" reaches. A check is made as to whether or not this distance "t'" is smaller than, or equal to a predetermined value.

When the calculated distance "t'" is smaller than, or equal to a predetermined value, it is so judged that as to this light incident plane 3*a*, the region to which the exposing light does not directly reach and therefore which could not be effectively utilized gives no adverse influence to the exposure process of the photosensitive film formed on the inner surface of the face panel. Then, the process operation is advanced to a step 1704. On the other hand, when the calculated distance "t'" is larger than, or equal to a predetermined value, it is so judged that as to this light incident plane 3*a*, the region to which the exposing light does not directly reach and therefore which could not be effectively utilized gives an adverse influence to the exposure process of the photosensitive film formed on the inner surface of the face panel. Then, the process operation is advanced to a step 1703. At the step 1703, the level difference plane 3*b* connected to the bottom portion side of the light incident plane 3*a* of interest at the previous step 1702 is again set to become parallel to the exposing light which passes through the summit portion position "f" of the light incident plane 3*a* located adjacent to the bottom portion side of this light incident plane 3*a*.

At the step 1704, a check is made as to whether or not the process operations defined at the above-explained steps 1702 and 1703 are accomplished as to all of the light incident planes 3*a* formed on the discontinuous lens 3. When these process operations are completed, the process operation is advanced to a step 1705, whereas when these process operations are not yet accomplished, the process operation is returned to the previous step 1702.

At the step 1705, the cutting process conditions of the work 133 are defined in order that the shape of the discontinuous lens 3 is transferred to the surface of the work 133. This shape of the discontinuous lens 3 is specified by the curvature and the inclinations "θx", "θy" of each of the light incident planes 3*a*, and further the height and the inclination of each of the level difference planes 3*b*, which have been set at the above-described steps 1701 to 1703. Then, the NC program used in this cutting process apparatus is set based on these cutting process conditions.

Next, the work 133 is cut in accordance with the NC program set at the step 1705 so as to manufacture the mold 131 shown in FIG. 10.

First, the surface of the work 133 is cut in by moving the X–Y stage 141 along the Y direction, and the surface of the work 133 is cut/fed by continuously moving the X–Y stage along the X direction, while varying the altitude of the diamond cutting tool 144 by way of the rotary table 142. As a consequence, a plane 131*a* of one column of the mold 131 indicated in FIG. 10 is cut. In this case, in FIG. 10, the inclination of the plane 131*a* along the Z direction in the X axis is cut by continuously moving the X–Y stage 141 along the X direction, while varying the position along the Y direction in FIG. 11. Also, in FIG. 10, the inclination of the plane 131*a* along the Z direction in the Y axis is cut by continuously moving the X–Y stage 141 along the X direction, while rotating the rotary table 142. It should be noted that in FIG. 11, the length of the cutting blade of the diamond cutting tool 144 is preferably made coincident with the length of one edge of the plane 131*a* along the Y direction in FIG. 10.

Thereafter, when the cutting process for one column is accomplished (step 1706), the Z-table 143 is moved along the Z-axis direction to execute the pitch feed operation of the work (step 1707), so that the cutting process for the next column is carried out. Then, when all of the columns are ended (step 1708), the diamond cutting tool 144 is returned to an origin position (step 1709), and this process operation in this flow chart is completed.

Then, a plastic working method of the mold shown in FIG. 10 will now be explained.

Figure 14:
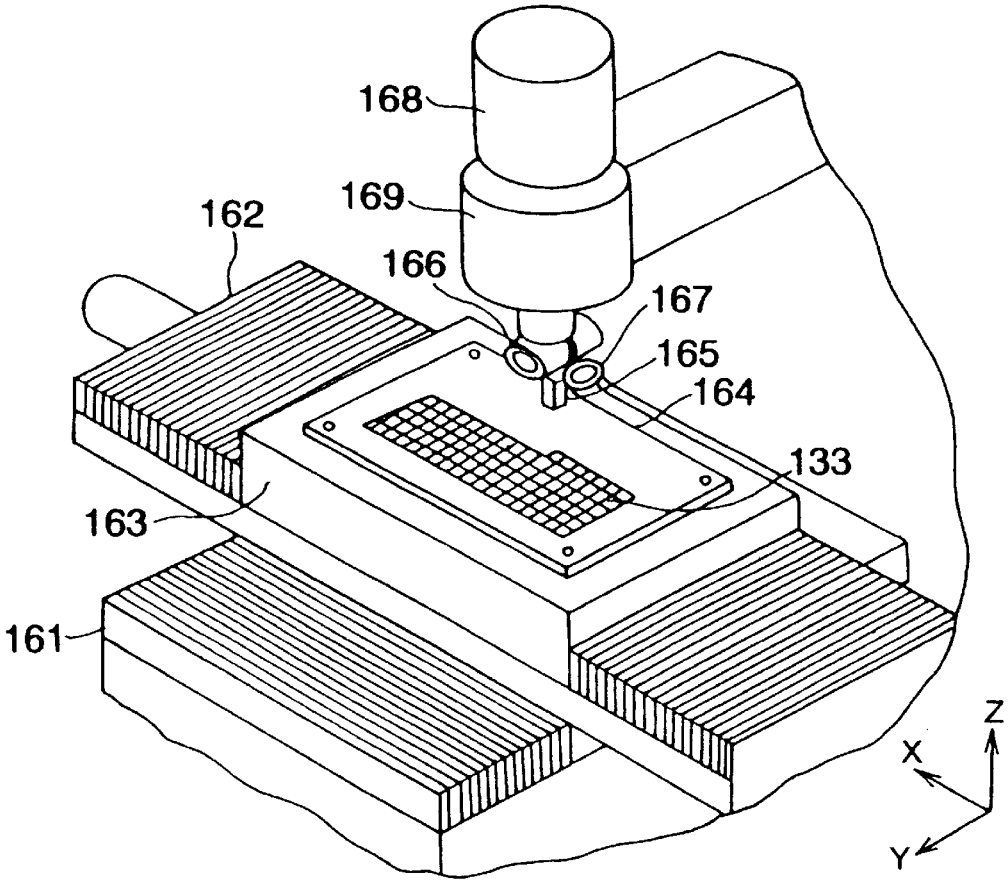
FIG. 14 illustrates a cutting work machine for the mold shown in FIG. 10.

FIG. 14 is a perspective view for schematically indicating a portion of a plastic working apparatus for the mold shown in FIG. 10.

The plastic working apparatus shown in FIG. 14 is constituted by employing an X table 161, a Y table 162, a positioning table 163 for fixing the work 133, a punch 165 functioning as a plastic working tool, an X-direction goniostage 166, a Y-direction goniostage 167, a Z-axis feeding apparatus 168, and a control apparatus 169.

The positioning table 163 is set in such a manner that this positioning table 163 is movable along the X direction and the Y direction by way of the X table 161 and the Y table 162.

The punch 165 is set in such a manner that this punch 165 is rotatable around a working plane of the punch 165 as a rotation center along the X direction and the Y direction by the X-direction goniostage 166 and the Y-direction goniostage 167. As a material of the punch 165, high hardness materials such as diamond, CBN, and an ultra hardness material are suitable. It should also be noted that a tip plane of the punch 165 is processed in advance in order that a preselected curvature is made in a surface of the work 133, which is intended to be processed.

The control apparatus 169 causes the punch 165 to be transported along the upper/lower direction so as to punch the surface of the work. As a result, the surface of the work 133 is plastic-worked. It should also be noted that the control apparatus 169 contains a force sensor and the like used to control and mange the depressing force of the punch 165 against the surface of the work 133.

The control apparatus 169, the X-radiation goniostage 166, Y-direction goniostage 167, and the punch 165 are mounted on a lower end portion of the Z-axis feeding apparatus 168 transportable along the vertical (Z axis) direction.

Next, a description will now be made of a plastic working process of the plastic working apparatus shown in FIG. 14.

Figure 15:
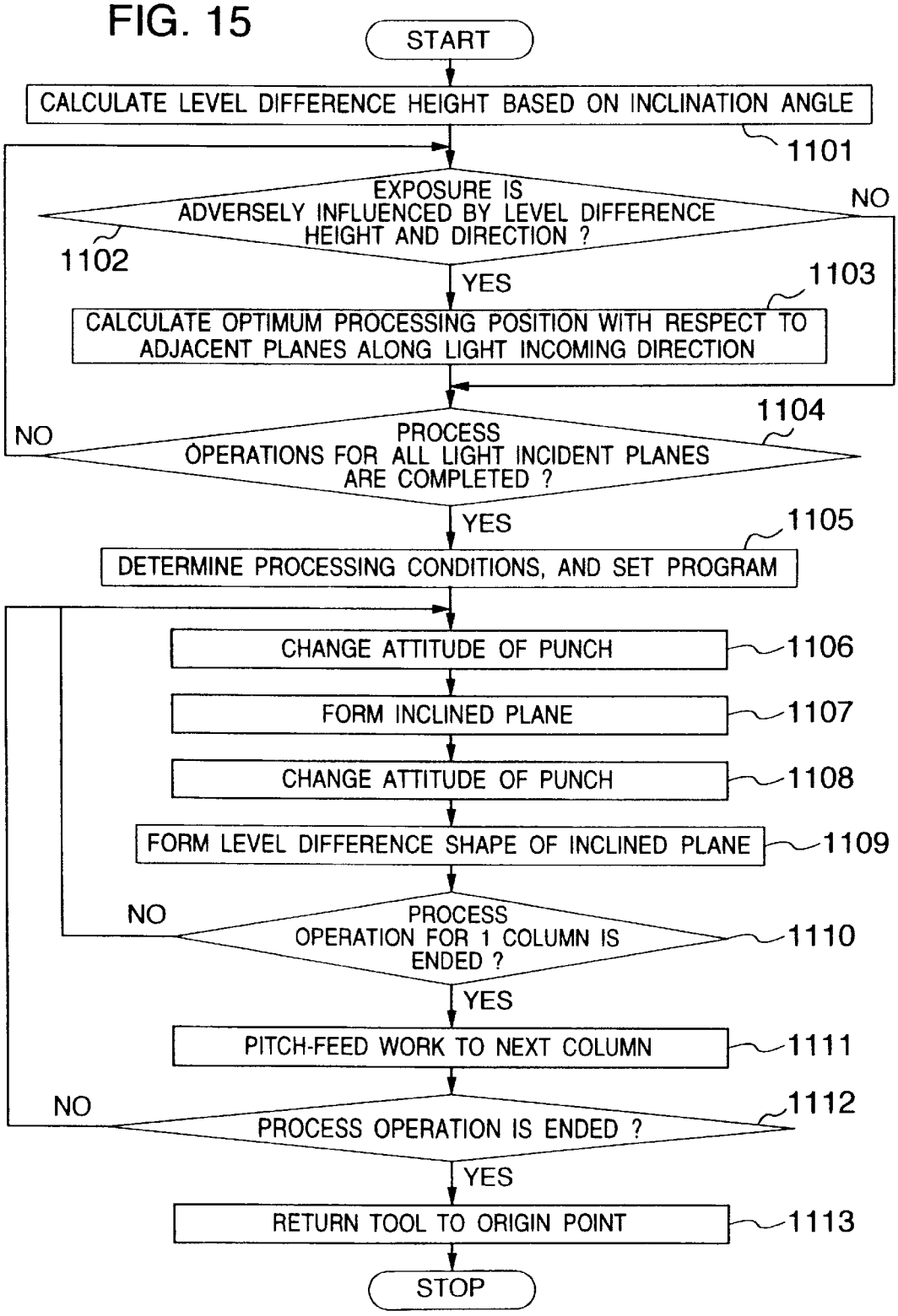
FIG. 15 is a flow chart for explaining a cutting work process operation of the cutting work machine shown in FIG. 14.

FIG. 15 is a flow chart for explaining the plastic working process by the plastic working apparatus shown in FIG. 14. It should be understood that since process operations defined from a step 1101 to a step 1104 of FIG. 15 are similar to those defined from the step 1701 to the step 1704 in the flow chart of FIG. 12, detailed descriptions thereof are omitted.

At the step 1105, the plastic working conditions of the work 133 are defined in order that the shape of the discontinuous lens 3 is transferred to the surface of the work 133. This shape of the discontinuous lens 3 is specified by the curvature and the inclinations "θx", "θy" of each of the light incident planes 3*a*, and further the height and the inclination of each of the level difference planes 3*b*, which have been set at the above-described steps 1101 to 1103. Then, the plastic working program used in this plastic working apparatus is set based on these plastic working conditions.

Next, the work 133 is plastic-worked in accordance with the plastic working program set at the step 1105 so as to manufacture the mold 131 shown in FIG. 10.

First, after the X table 161 is moved to perform the positioning operation for a plane to be processed in the work 133, the attitude of the punch 165 is controlled by the X-direction goniostage 166 and the Y-direction goniostage 167 in order that a predetermined inclination is given to the plane to be processed in the work 133 (step 1106).

Next, the Z-axis feeding apparatus 168 causes the punch 165 to descend, so that the tip face of the punch 165 is depressed against the plane of the work 133 to be processed. Thereafter, the depression force of the punch 165 is controlled by the control apparatus 169 to perform the punching operation (step 1107). As a consequence, the plastic working operation of a certain plane 131*a* of the mold 131 shown in FIG. 10 is carried out.

Next, in the mold 131 indicated in FIG. 10, the X table 161 is moved to perform the positioning operation for a plane to be processed in the work 133 in order to plastic-work the level difference plane 131*b* connected to the plane 131*a* formed at the step 1107. Thereafter, the attitude of the punch 165 is controlled by the X-direction goniostage 166 and the Y-direction goniostage 167 in order that a predetermined inclination is given to the plane to be processed in the work 133 (step 1108).

Next, the Z-axis feeding apparatus 168 causes the punch 165 to descend, so that the tip face of the punch 165 is depressed against the plane of the work 133 to be processed. Thereafter, the depression force of the punch 165 is controlled by the control apparatus 169 to perform the punching operation (step 1109). As a consequence, the plastic working operation of the level difference plane 131*b* is carried out.

When the plastic working operations for the plane 131*a* of one column of the mold 131, and the level difference plane 131*b* of this mold 131 shown in FIG. 10 are accomplished by carrying out the process operations defined at the step 1106 to the step 1109 (step 1110), the Y table 162 is moved to pitch-feed the mold (step 1111), so that the plastic working operation for the next column is carried out. Then, when the plastic working operations for all of the columns are ended (step 1112), the punch 165 is returned to the origin position (step 1116), and then this flow operations is completed.

Figure 3:
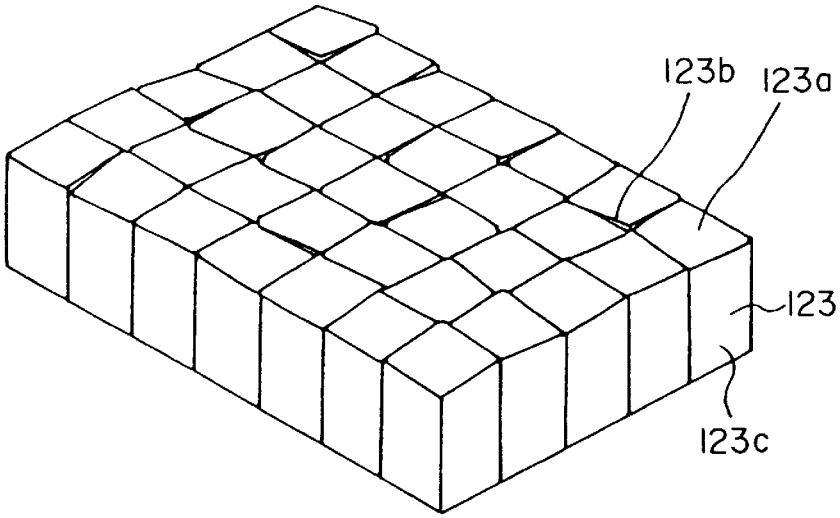
FIG. 3 PRIOR ART
FIG. 3 is a perspective view for schematically indicating the mold for forming the conventional discontinuous lens.
Figure 4:
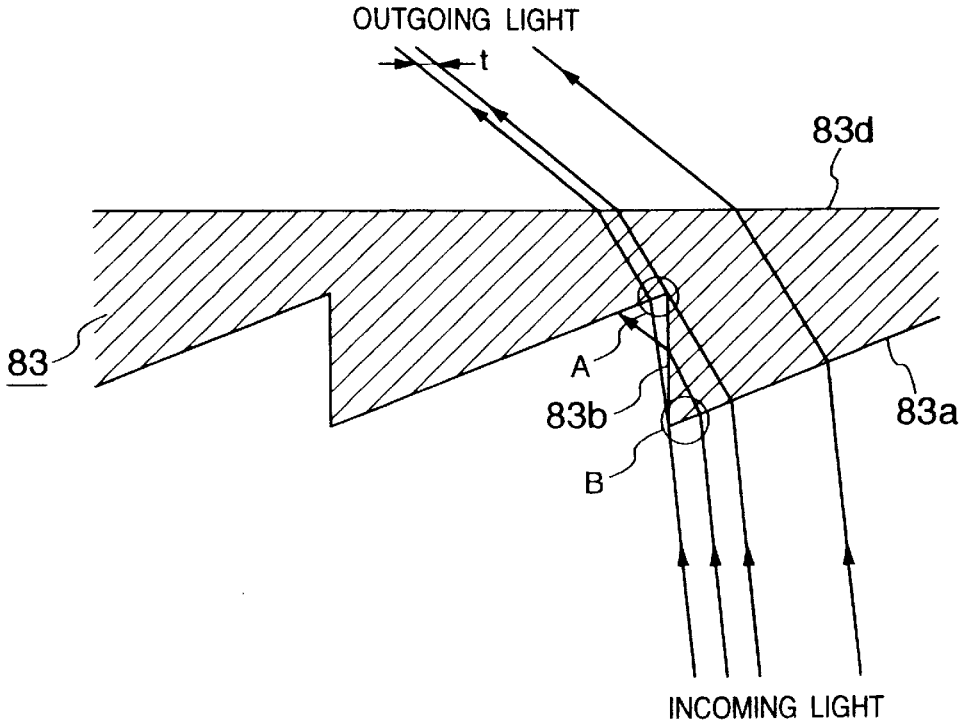
FIG. 4 PRIOR ART
FIG. 4 is a view for partially enlarging the conventional discontinuous lens.

In accordance with the above-explained cutting process method and plastic working method, it is possible to form the planes on the surfaces of one mold material, and these planes correspond to the transferred planes (namely, light incident plane 3*a*, level difference plane 3*b*, reference plane 3*c*) of the discontinuous lens 3. As described above, since the mold used to form the discontinuous lens is manufactured by employing one mold material, the areas of the planes corresponding to the light incident planes of the discontinuous lens, and the heights of the planes corresponding to the level planes thereof can be made smaller than those of the assembled type mold, as explained in the prior art of FIG. 3. As a consequence, since the areas of the light incident planes, and the heights of the level difference planes of the discontinuous lens can be made small, the orbit of the exposing light can be more precisely controlled in the light exposure stage for forming the fluorescent film of the face panel. As a consequence, these processing methods of the present invention can give sufficient satisfaction to the needs to manufacture a high-definition color cathode-ray tube. As a consequence, it is possible to manufacture high-definition television sets and high-definition monitors for terminals.

As an experimental result made by the Applicants or Inventors, since the mold is manufactured by way of the above-described cutting process method and plastic working method, the pitch of the light incident planes of the discontinuous lens according to the present embodiment could be reduced up to approximately 2 mm, although the pitch of the prior art discontinuous lens is on the order of 8 mm. Also, the height of the level difference plane could be reduced smaller than, or equal to 5 $\mu$m, although that of the conventional discontinuous lens is approximately 100 $\mu$m.

Also, according to the present embodiment, since the planes corresponding to the shape of the discontinuous lens are formed by way of the cutting process and the plastic machine process on the surface of one mold material, the planes 131*b* corresponding to the level difference planes of the discontinuous lens can be formed at the various angles. To the contrary, as previously explained, since the respective blocks for constituting the mold are assembled with each other without any space in the conventional assembled type mold, the level differences among the respective blocks should be positioned perpendicular to the rear plane of the mold. In other words, since one body type mold is employed which is formed from one mold material by the above-described cutting process method and plastic working process, it is possible to form the discontinuous lens equipped with the level difference planes 3*b* having the inclinations with respect to the light projection planes, as illustrated in FIG. 5 and FIG. 6.

It should be understood that the above-described one body type mold may be manufactured by employing the discharge processing method other than the above-explained cutting process method and the plastic working method.

Subsequently, a description will now be made of an exposing method used to form a face panel fluorescent film of a color cathode-ray tube with employment of the discontinuous lens 3.

Figure 16:
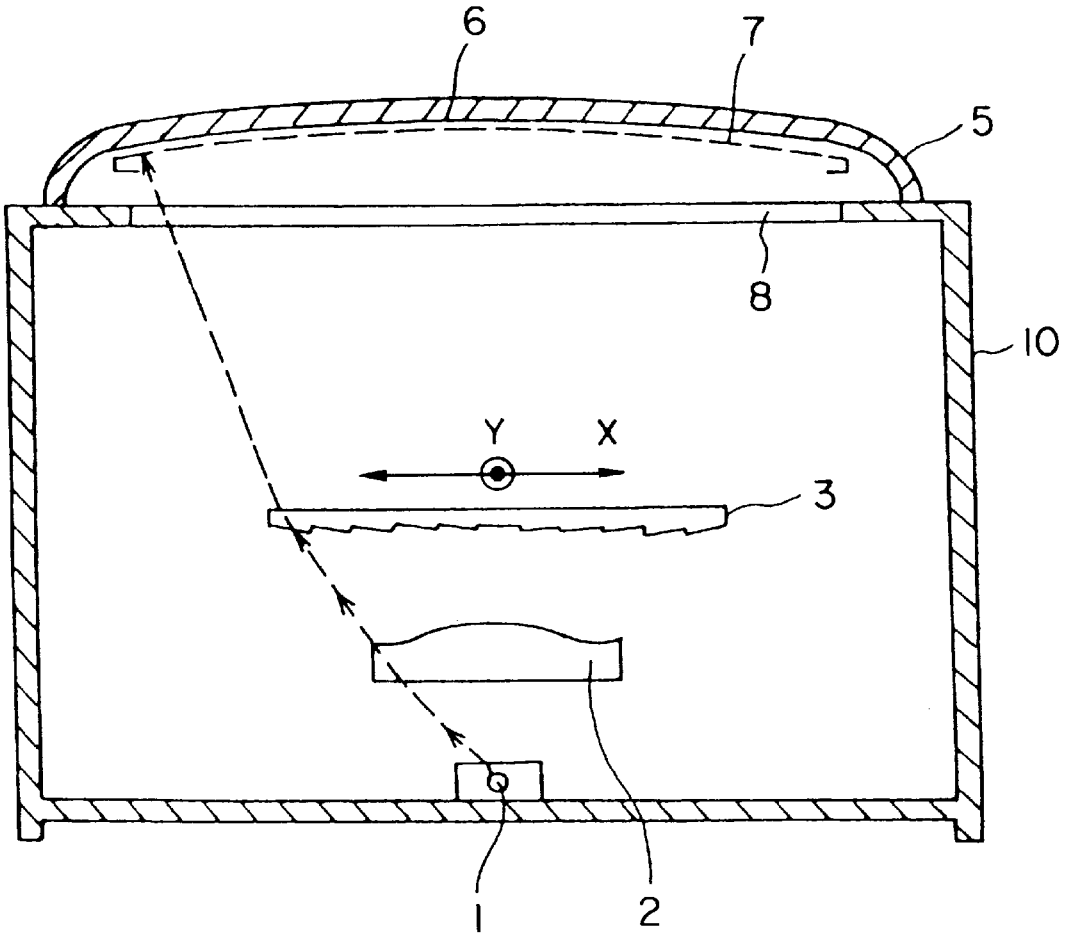
FIG. 16 is a schematic structural diagram of a light exposure base used to form a face panel fluorescent film by employing the discontinuous lens indicated in FIG. 5.

FIG. 16 is a schematic structural diagram of a light exposure base used to form a fluorescent film of a color cathode-ray tube with employment of the discontinuous lens 3. Within the light exposure base 10 shown in FIG. 16, constructive elements are provided in this order of the exposing light source 1, the continuous lens 2, and the discontinuous lens 3 from the lower position to the upper position. An opening portion 8 through which the exposing light emitted from the exposing light source 1 may pass is formed in an upper surface of the light exposure base 10. Also, a face panel 5 where a shadow mask 7 is mounted on an inner surface thereof is installed on the light exposure base 10. It should be noted that a photosensitive film 6 is coated on the inner surface of the face panel 5. Also, the discontinuous lens 3 is swung by a swinging apparatus (not shown along the X direction and the Y direction (namely, direction perpendicular to a paper plane).

It should be understood that the light exposure base 10 indicated in FIG. 16 is arranged in a similar manner to the conventional light exposure base 84 shown in FIG. 1 except for the following points. That is, in this light exposure base 10 of FIG. 16, the discontinuous lens 3 is used, and when the height of the level difference plane 3*b* of the discontinuous lens 3 becomes larger than, or equal to a preselected value, this discontinuous lens is swung by the swinging apparatus (not shown in detail).

As explained before, in the discontinuous lens 3, the respective level difference planes 3*b* are formed in such a manner that these level difference planes 3*b* are positioned in parallel to the optical path of the exposing light which passes through the boundary between the level difference planes 3*b* and the light incident planes connected to these level difference planes 3*b*. As a consequence, even when the discontinuous lens 3 is used in the conventional light exposure base shown in FIG. 1, it is possible to avoid such a problem. That is, the insufficiently exposed portion having the width corresponding to the height of the level difference plane 3*b* of the discontinuous lens 3 is formed in the photosensitive film coated on the inner surface of the face panel 5.

As previously described, the height of each of the level difference planes 3*b* depends upon the inclinations "θx" and "θy" of the light incident planes 3*a* located adjacent to each other via this level difference plane 3*b*. When the inclinations "θx" and "θy" of the light incident planes 3*a* are increased, the heights of the level difference planes 3*b* are also increased. The Applicants, or Inventors could confirm that when the height of this level difference plane 3*b* was excessively increased, the striped light/dark line patterns were produced in such a cathode-ray tube that the exposure operation for producing the face panel fluorescent film was carried out by using the conventional light exposure base with employment of this discontinuous lens 3. Concretely speaking, when the fluorescent film of the face panel of the 21-inch color cathode-ray tube was formed by utilizing the light exposure base with employment of the discontinuous lens 3, if the height of the level difference plane 3*b* of the discontinuous lens 3 exceeded 40 $\mu$m, then the above-described latticed light/dark line patterns are produced during operation of this 21-inch color cathode-ray tube.

To avoid such a problem, in the light exposure base 10 shown in FIG. 16, when the height of the level difference plane 3*b* of the employed discontinuous lens 3 becomes larger than, or equal to a preselected value, this discontinuous lens 3 is swung in an asynchronous mode along the X direction by using the swinging apparatus (not shown). In this embodiment, the asynchronous swinging mode implies that the swinging operation along the X direction is performed not in synchronism with the swinging operation along the Y direction. Since the discontinuous lens is swung in the asynchronous mode along the X direction and the Y direction, an irradiation amount of the exposing light which is irradiated onto the inner surface of the face panel 5 with predetermined time can be made uniform. As a result, the portions corresponding to the dots and the stripes of the photosensitive film 6 coated on the inner surface of the face panel 5 can be exposed under uniform conditions. Therefore, the above-mentioned latticed light/dark line patterns produced while the cathode-ray tube is operated can be lowered.

It should be understood that the swing stroke amounts of the discontinuous lens 3 along the X direction and the Y direction are preferably selected to be smaller than, or equal to lengths of edges of the light incident planes 3*a* in parallel to the swinging direction. When the swinging stroke amount becomes larger than the pitch of the light incident plane 3*a*, since the inclinations "θx" and "θy" of the respective light incident planes 3*a* of the discontinuous lens may have various values, the corrected optical paths will interfere with each other. As a result, the amounts of the exposing light reached the photosensitive film become ununiform, so that the formation of the fluorescent patterns is fluctuated.

Figure 17:
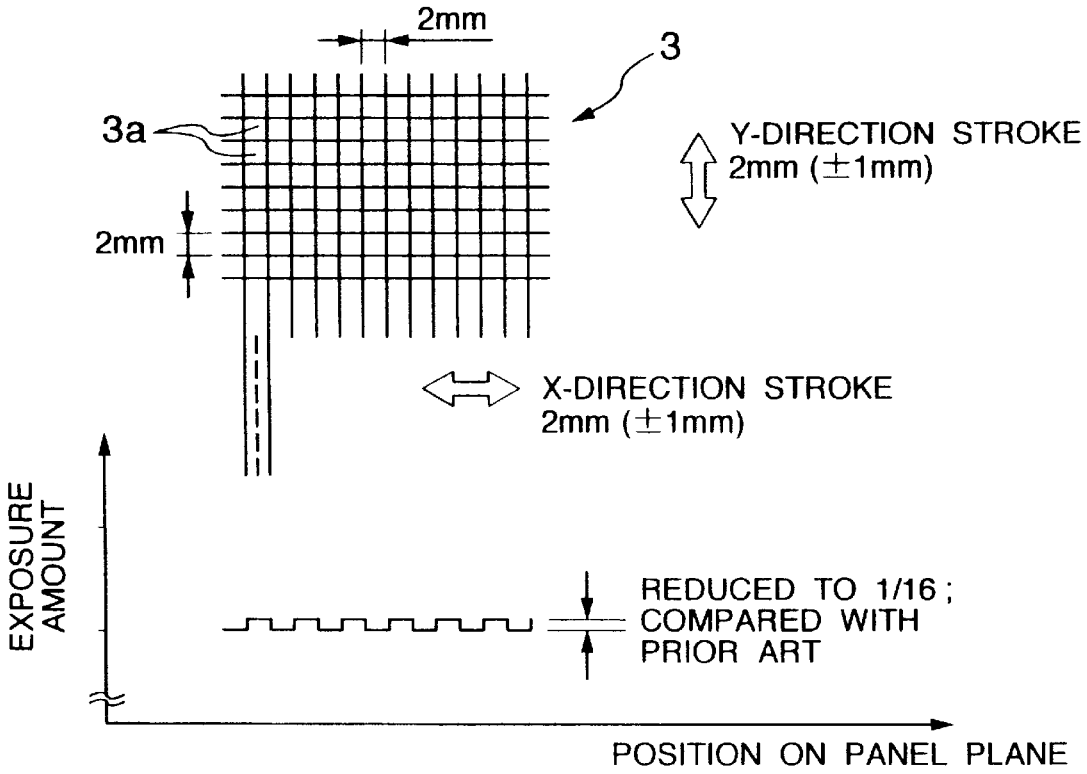
FIG. 17 is a diagram for explaining a swing operation of the discontinuous lens of the light exposure base indicated in FIG. 16.

As a experimental result made by the Applicants, or the Inventors, as illustrated in FIG. 17, in the case that the discontinuous lens 3 whose light incident planes 3*a* had the pitches of 2 mm along the X direction and the Y direction was used, and this discontinuous lens was swung in the asynchronous mode under the swinging stroke amounts of 2 mm±1 mm along the X direction and the Y direction to thereby form the face panel fluorescent film of the 21-inch color cathode-ray tube, the contrast of the light/dark lines produced while the 21-inch color cathode-ray tube was operated could be improved by 1/16, as compared with the following case. That is, the conventional light exposure base shown in FIG. 1 was used to form the fluorescent film of the face panel of the 21-inch color cathode-ray tube, while using the prior art discontinuous lens whose incident light planes had the pitches of 8 mm along the X direction and the Y direction.

Next, a description will now be made of an evaluation result about a landing error amount while electron beams are irradiated onto the color cathode-ray tube according to this embodiment, on which the fluorescent dot patterns have been formed in accordance with the above-mentioned exposing method.

Figure 18A:
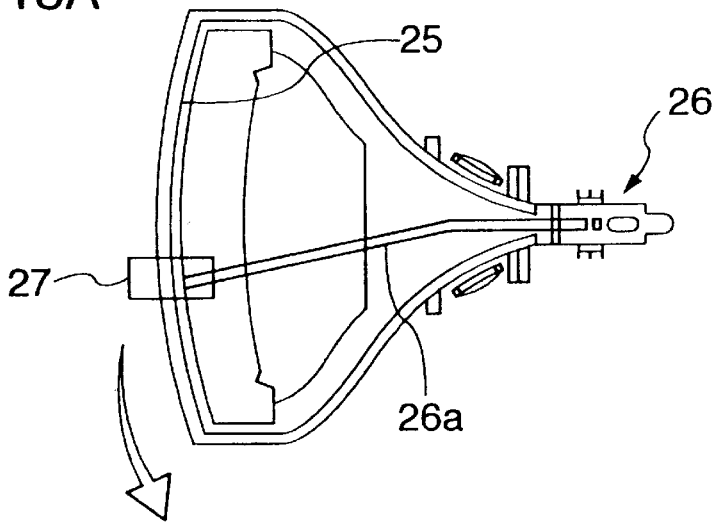
FIGS. 18A, 18B and 18C are diagrams for explaining the color cathode-ray tube according to the first embodiment of the present invention, and a method for evaluating a landing error amount thereof.

FIG. 18A is a sectional view for schematically representing a color cathode-ray tube, according to this embodiment, on which fluorescent dot patterns have been formed by way of the above-described exposing method. In this case, in order to evaluate a landing error amount in the color cathode-ray tube according to this embodiment, electron beams 26*a* emitted from an electron gun 26 were irradiated onto the inner surface of the face panel 25 to thereby illuminate the fluorescent dot patterns formed on the inner surface of face panel 25. Under this condition, the surface of the face panel 25 was imaged by a microscopic camera 27. Then, the landing error amount was evaluated by measuring the positional shifts between the arrival positions of the electron beams and the positions of the fluorescent dots by using the developed photographs.

Figure 18B:
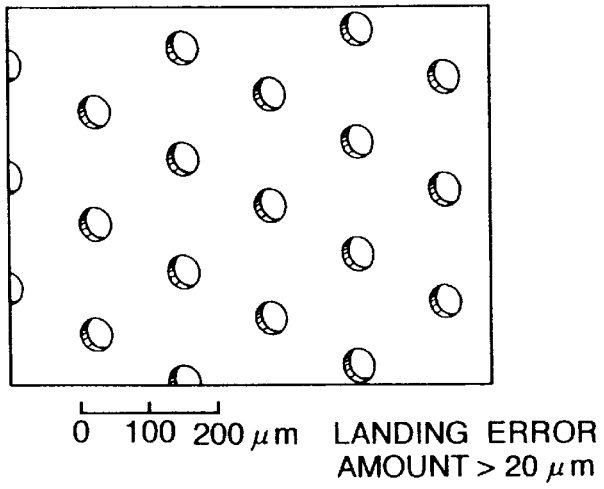
Figure 18C:
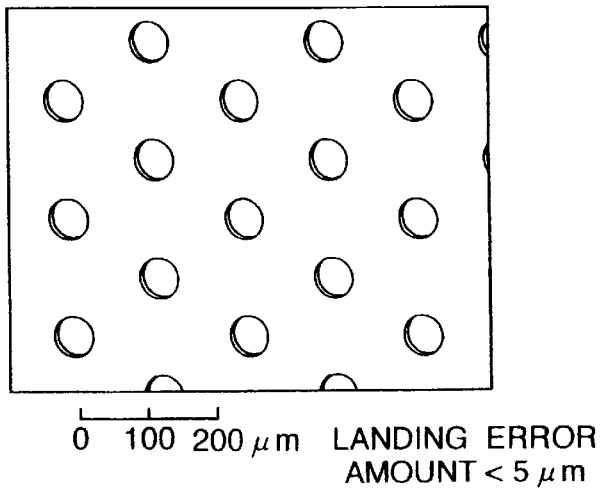

FIG. 18B and FIG. 18C are illustrations of the photographs obtained by the above-explained evaluation method. FIG. 18B is an illustration of a photograph when the face panel is employed on which the fluorescent dot pattern is formed by employing the conventional discontinuous lens shown in FIG. 1. FIG. 18C is another illustration of another photograph when the face panel is used on which the fluorescent dot pattern is formed by employing the discontinuous lens of the present invention. In this drawing, hatched portions represent positional shifts between the arrival positions of the electron beams and the positions of the fluorescent dots.

The positions and the shapes of the fluorescent dots formed on the face panel are fluctuated by the shape and the precision of the discontinuous lens. In particular, there is a trend such that the fluctuation amount of the four corners of the face panel becomes larger than that of the center thereof. This is because of such a feature that the inclinations θx, θy of the light incident planes of the discontinuous lens are gradually increased along the four corners. In connection of increasing of the inclinations θx and θy, the heights of the level difference faces are increased along the four corners. As a result, the positional shifts between the positions of the fluorescent dots and the places where the electron beams reach are increased along the four corners of the face panel, so that the landing error amount is increased.

As a consequence, in order to reduce this landing error amount, the areas of the respective light incident planes of the discontinuous lens are decreased, and thus the heights of the level difference planes must be wholly suppressed. In view of this requirement, since the discontinuous lens 3 is formed by employing the one body type mold manufactured by way of the above-described processing method, as previously explained, the pitch of the light incident plane 3*a* can be reduced from 8 mm (prior art) to 2 mm (present invention). In connection therewith, the height of the level difference plane 3*b* could be reduced from approximately 100 μm (prior art) to approximately 5 μm (present invention). As a result, as illustrated in FIG. 18C, the landing error amount could be reduced up to approximately 5 μm. To the contrary, the landing error amount is larger than, or equal to 20 μm in the face panel on which the fluorescent dot patterns are formed by employing the conventional discontinuous lens, as shown in FIG. 18B.

Next, referring to drawings, a second embodiment of the present invention will now be described.

In accordance with the first embodiment, the portion near the bottom portion of the light incident plane in the discontinuous lens is effectively used, and lowering of the luminous flux density of the exposing light projected from the light projection plane is prevented, which is lowered in unit of width corresponding to the height of the level difference plane every preselected interval. In contrast to this first embodiment, in a discontinuous lens employed in the second embodiment, such a region is clearly and uniformly made that luminous flux density of exposing light projected from the light projection plane is lowered in unit of a width corresponding to a height of a level difference plane every preselected interval.

Figure 19:
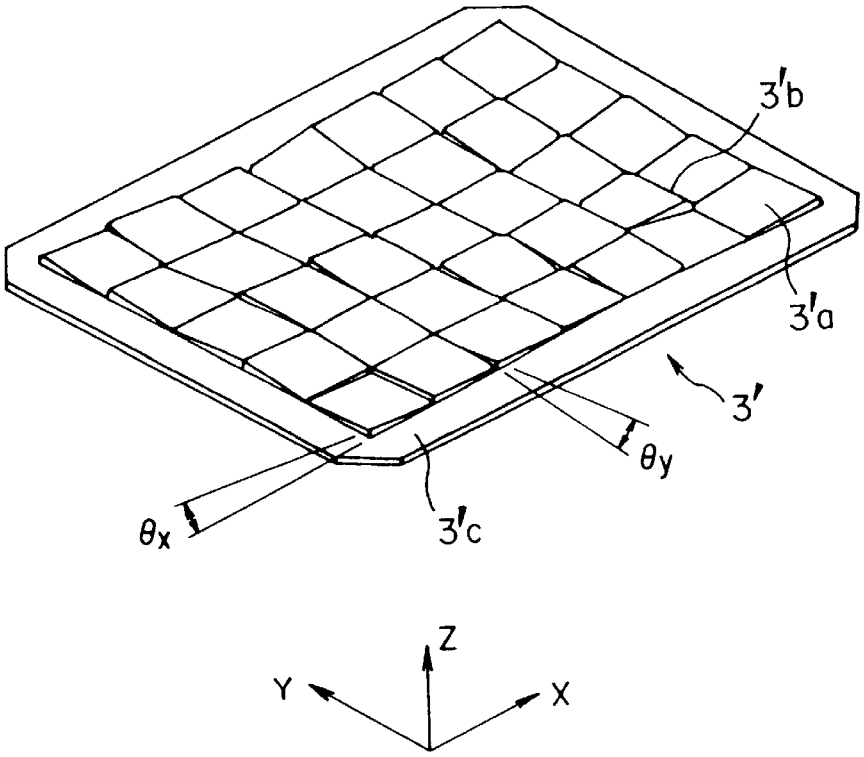
FIG. 19 is a perspective view for schematically representing a discontinuous lens employed in a color cathode-ray tube according to a second embodiment of the present invention.
Figure 20:
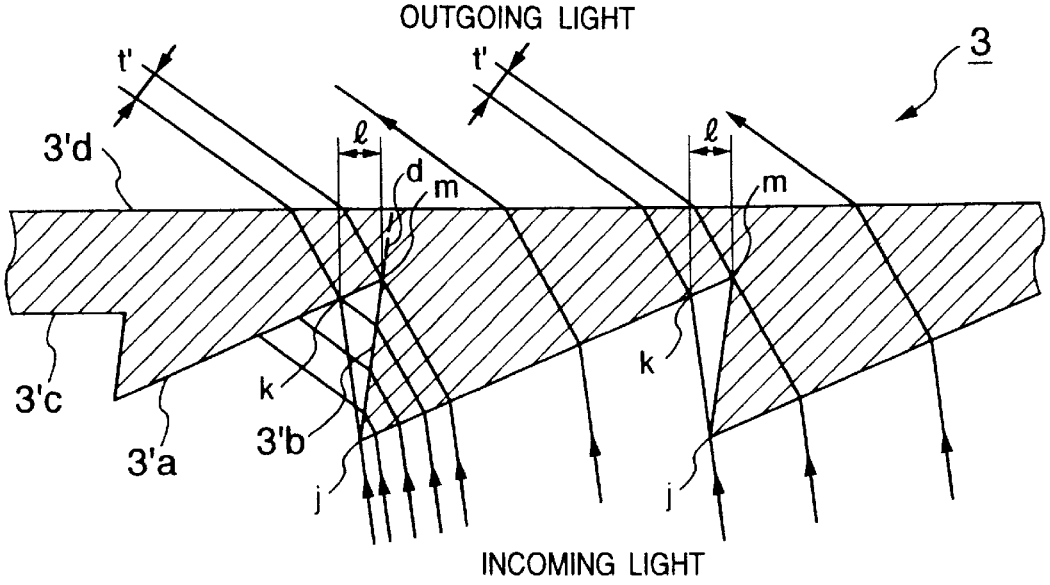
FIG. 20 is a schematic diagram for partially enlarging the discontinuous lens indicated in FIG. 19.

FIG. 19 is a perspective view for schematically indicating a discontinuous lens employed in a color cathode-ray tube according to the second embodiment of the present invention. FIG. 20 is a sectional view for schematically showing a portion of the discontinuous lens shown in FIG. 19, which corresponds to FIG. 7, i.e., the first embodiment.

The discontinuous lens 3' owns the following different points from those of the discontinuous lens 3 employed in the first embodiment. That is, as indicated in FIG. 20, an angle "α" of a level difference plane 3'*b* connected to a bottom portion of a light incident plane 3'*a* of interest with respect to a reference plane 3'*c* is set in such a manner that a distance "l" becomes a preselected value, and this distance "l" is defined from an arrival position "k" of exposing light which passes through a summit portion pint "j" of another light incident plane 3'*a* connected to this level difference plane 3'*b* up to a bottom portion position "m" of the first-mentioned light incident plane 3'*a* of interest. It should be noted that the above-described distance "l" is preferably made longer as being permitted in order to make such a region more clearly and more uniformly, in which the luminous flux density of the exposing light is low and which is made every preselected interval in unit of the width corresponding to the height of the level difference plane 3'*b*.

The Applicants, or the Inventors could confirm that when the incident angle of the exposing light with respect to the reference plane 3'*c* is lower than, or equal to 120 degrees, if the angle "α" of the level difference plane 3'*b* with respect to the reference plane 3'*c* is made as an obtuse angle of on the order of 120 degrees, then the region made every predetermined interval, in which the luminous flux density of the exposing light is low can be made more clearly and more uniformly. This fact may be conceived by that, as shown in FIG. 20, the above-described distance "l" can be made longer, and also the exposing light which is entered via the light incident plane 3'*a* into the level difference plane 3'*b* can be dispersed over a relatively wide region.

In general, there are some possibilities that the shape of the discontinuous lens 3' as shown in FIG. 20 is not proper, considering that the discontinuous lens is released from the mold. However, as previously described in the first embodiment, one body type mold is manufactured from one mold material by way of the cutting process method, or the plastic working method, so that the height of the plane of the mold with respect to the level difference plane of the discontinuous lens can be reduced up to on the order of 5 μm. As a consequence, since optical plastic having superior flexibility characteristics is employed as the lens material, the discontinuous lens functioning as the final product can be easily released from this mold.

Now, a description will be made of a reason why the discontinuous lens 3' having such as shape is made. That is, the region in which the luminous flux density of the exposing light projected from the light projection plane 3'*d* is lowered in unit of the width corresponding to the height of the level difference plane 3'*b* every preselected interval can be made more clearly and more uniformly.

In the case that the discontinuous lens 3' is employed in the conventional light exposure base as indicated in FIG. 1, and then the exposing operation for producing the face panel fluorescent film is carried out, the insufficiently exposed portions are formed every preselected interval in unit of the width corresponding to the above-described distance "l". This insufficiently exposed portion may use dark line patterns, the widths and contrast of which are made more uniformly, when the cathode-ray tube with employment of this face panel is operated, as compared with those of the prior art.

However, if the discontinuous lens 3' is employed in the light exposure base as previously explained in the first embodiment of FIG. 16 to execute the exposing operation for forming the face panel fluorescent film, then it is possible to uniform an irradiation amount of exposing light which is irradiated onto the inner surface of the face plate within preselected time. In other words, in the discontinuous lens 3', the region in which the luminous flux density of the exposing light projected from the light projection plane is lowered in unit of the width corresponding to the height of the level difference plane every preselected interval is made more clearly and more uniformly, as compared with the case when the conventional discontinuous lens is employed. Therefore, since the discontinuous lens 3' is swung in the asynchronous mode along the X direction and the Y direction, the irradiation amount of the exposing light can be made more uniformly, which is irradiated onto the inner surface of the face panel within predetermined time. As a result, it is possible to manufacture a high-definition color cathode-ray tube having a higher image quality.

It should also be noted that although the level difference plane 3'*a* in the discontinuous lens 3' has been formed in such a manner that the above-explained distance "l" becomes constant, this level difference plane 3'*b* may be alternatively formed in such a manner that both the exposing light entered into one light incident plane 37*a* located adjacent to this level differences plane 3'*b*, and the exposing light entered into the other light incident plane 3*a* are projected from the light projection plane 3'*d* in a constant interval.

Figure 21:
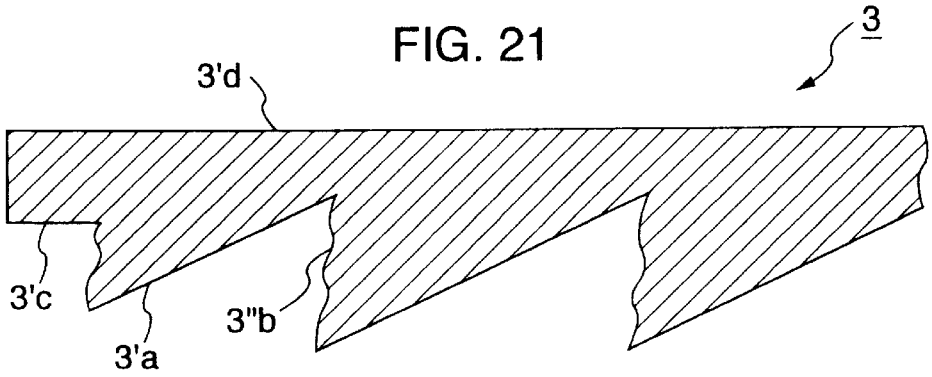
FIG. 21 is a diagram for explaining a modification of the discontinuous lens shown in FIG. 20.

For instance, as shown in FIG. 21, several to several tens of scratches are formed in a level difference plane 3" to deteriorate the plane, so that the light transmissivity on the level difference plane 3"*b* may be lowered. As a result, since the exposing light reached on the level difference plane 3"*b* may be dispersed over a wide region on this level difference plane 3"*d*, such a region can be made more clearly and more uniformly, in that the luminous flux density of the exposing light projected from the light projection plane 3'*b* is lowered in unit of the width corresponding to the height of the level difference plane 3"*b* every preselected interval.

Alternatively, the light projection plane 3'*d* may be formed in such a way that the light transmissivity of the portion from which the exposing light reached on the level difference plane 3'*b* is projected is made low. In other words, in the light projection plane 3'*d* of the discontinuous lens 3', the plane thereof may be deteriorated by employing the following manner. That is, scratches, or cracks having a constant width may be formed in a portion where after the exposing light has once been entered into the light incident plane 3'*a*, this exposure light is projected form the level difference plane 3'*b* and then is reached to another light incident plane 3'*a* connected to this level difference plane 3'*b*, may interfere with the exposing light which has directly reached on this other light incident plane 3'*a*. As a consequence, since the exposing light projected from this portion can be dispersed, such a region can be made more clearly and more uniformly, in that the luminous flux density of the exposing light projected from the light projection plane 3'*b* is lowered in unit of the width corresponding to the height of the level difference plane 3"*b* every selected interval. It should be understood that when the light projection plane 3'*d* of the discontinuous lens 3' is deteriorated, the inclination of the level difference plane 3'*b* need not be made as the obtuse angle with reference to the reference plane 3'*b*, but may be made as a right angel, or an acute angle.

It should also be noted that a method for forming the discontinuous lens 3' is identical to the method for forming the discontinuous lens 3 employed in the first embodiment. Also, a method for processing a mold used to form the discontinuous lens 3' is similar to that of the first embodiment. Now, as one example, a method for cutting a mold used to form the discontinuous lens 3' shown in FIG. 21 will be described.

Figure 22:
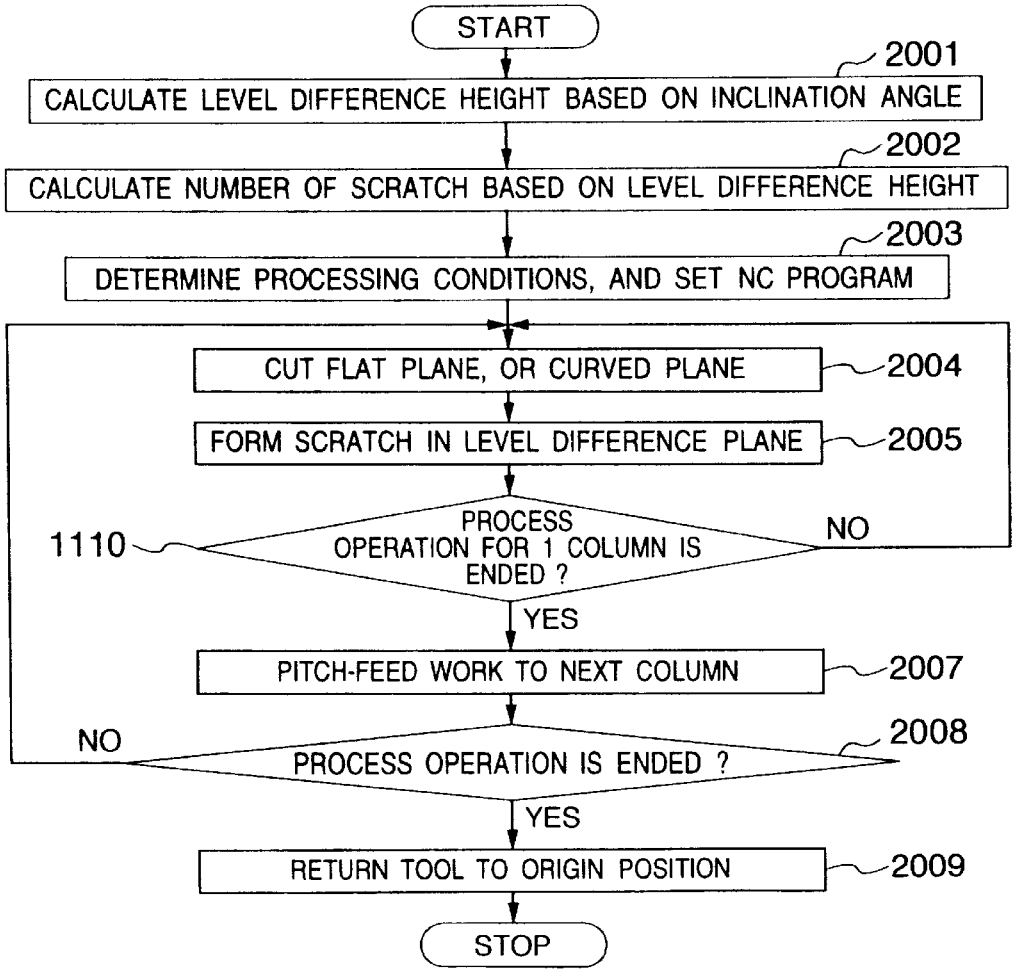
FIG. 22 is a flow chart for describing a cutting work process operation of a mold used to form the discontinuous lens shown in FIG. 19.

FIG. 22 is a flow chart for explaining a cutting process of the mold used to form the discontinuous lens 3'. It should also be noted that a cutting process apparatus for the mold used to form the discontinuous lens 3' is similar to that shown in FIG. 11.

In the flow chart, a calculation is made of a curvature, and inclinations "θx", "θy" of each of the light incident planes 3', and also a height of each of the level difference planes 3"*b*, which are formed in the discontinuous lens 3' (step 2001). This calculating method is carried out in a similar manner to the calculating method defined at the step 1701 shown in FIG. 12.

Next, based on the heights of the respective level difference planes 3"*b* calculated at the step 2001, the number of scratches formed in the respective level difference planes 3'*b*, and also an optimum processing position are determined (step 2002).

At a further step 2003, cutting process conditions of a work used as a mold material are determined in order that a shape of the discontinuous lens 3' can be transferred to the surface of this work, and this shape of the discontinuous lens 3' is specified by the curvatures and the inclinations θx, θy of the respective light incident planes, and the height of the respective level difference planes 3"*b*, and also the number of scratches, which are set at the steps 2001 and 2002. Then, an NC program used in this cutting process apparatus is set based on the process conditions.

Next, the work is cut-processed based on the NC program set at the step 2003 to manufacture the mold.

First, the cutting process is carried out for a plane corresponding to one light incident plane 3'*a* (step 2004). Thereafter, scratches are formed in another plane corresponding to the level difference plane 3"*b* connected to this light incident plane 3'*a* (step 2005). Then, the process operations defined from the step 2004 to the step 2005 are repeated until the cutting process is completed for the planes corresponding to the one column of the light incident plane 3'*a* in the discontinuous lens 3'. In this embodiment, the formation of these scratches in the plane corresponding to the level difference plane 3"*b* of the discontinuous lens is carried out by controlling the X–Y stage in such a way that the feed amount of the cutting process is varied every preselected pitch. As a consequence, concaves and convexes having the scratch shape of approximately 0.5 μm in depth may be produced in the planes corresponding to the level difference plane 3"*b* of the discontinuous lens 3'.

Thereafter, when the cutting process for 1 column is accomplished (step 2006), the pitch feeding operation of the mold is carried out (step 2007), and then the cutting process for the next column is performed. Then, when the cutting process is ended for all of the columns (step 2008), the cutting tool is returned to the origin position (step 2009) and this flow operation is accomplished.

It should be understood that the present invention is not limited to the above-described embodiments, but may be changed, modified, or substituted without departing from the technical scope and spirit of the present invention.

That is, the discontinuous lens employed in the color cathode-ray tube according to the present invention, is constituted by a plurality of very small light incident planes. When this discontinuous lens is employed in the light exposure base for producing the face panel fluorescent film, it is possible to suppress that the luminous flux density of the exposing light irradiated from the light projection plane of the discontinuous lens is lowered in unit of the width corresponding to the height of the level difference plane every preselected interval.

Also, in such a case that the discontinuous lens employed in the color cathode-ray tube of the present invention is employed in the light exposure base equipped with the discontinuous lens swinging apparatus as shown in FIG. 16, the region can be made more clearly and more uniformly, in which the luminous flux density of the exposing light irradiated from the light projection plane of the discontinuous lens is lowered in unit of the width corresponding to the height of the level difference plane every preselected interval.

Furthermore, for instance, both the light incident plane and the level difference plane of the discontinuous lens may be formed in accordance with the method of the first embodiment, and then the light projection plane thereof may be formed in accordance with the second embodiment in such a manner that the scratches, or the cracks having the constant widths are formed so as to deteriorate the plane. With employment of such a modification, when this discontinuous lens is employed to form the face panel fluorescent film, it is possible to suppress the light and dark line patterns produced while the cathode-ray tube is operated.

As previously described, according to the present invention, the light and dark line patterns produced when the cathode-ray tube is operated can be suppressed. Also, the landing error amount of the electron beams of the cathode-ray tube can be reduced. As a consequence, it is possible to provide television sets and monitors for terminal units, which can own the high-definition characteristics and high image qualities.

We claim:

1. A color cathode-ray tube wherein:

more than 1,000,000 pixels of fluorescent dot patterns having a dot pitch smaller than, or equal to 0.3 mm are formed on a face panel; and when the fluorescent dot patterns are irradiated by electron beams, a landing error of said electron beams onto the fluorescent dot patterns is smaller than, or equal to 20 μm.

2. A color cathode-ray tube as claimed in claim 1 wherein:

said fluorescent dot patterns are formed by being exposed via a shadow mask while swinging at least one axis of a correction lens constituted by a plurality of flat planes, or a plurality of curved planes, along X-axis and Y-axis directions.

3. A color cathode-ray tube as claimed in claim 2, wherein:

said correction lens is formed in such a manner that a level difference between said flat planes, or said curved planes, which constitute said correction lens and are located adjacent to each other is made smaller than or equal to 5 μm;

and said fluorescent dot patterns are exposed by employing said correction lens so as to be formed.

4. A color cathode-ray tube as claimed in claim 3 wherein:

said correction lens owns a plane for forming said level difference which is formed in parallel to a light incident direction of said exposing light to said correction lens; and said fluorescent dot patterns are exposed by employing said correction lens.

5. A color cathode-ray tube as claimed in claim 3 wherein:

said correction lens owns a plane for forming said level difference which is inclined at an angle smaller than, or equal to 120 degrees with respect to a reference plane of said correction lens; and said fluorescent dot patterns are exposed by employing said correction lens.

6. A color cathode-ray tube as claimed in claim 3 wherein:

said correction lens owns a region for reducing light transmissivity of said exposing light, which is formed with a uniform width on a plane from which said exposing light is projected; and said fluorescent dot patterns are exposed by employing said correction lens.

7. A color cathode-ray tube as claimed in claim 3 wherein:

said correction lens owns a plane for forming said level difference equipped with very small concaves and convexes, which is inclined at an angle smaller than, or equal to 120 degrees with respect to a reference plane of said correction lens; and said fluorescent dot patterns are exposed by using said correction lens.

8. A color cathode-ray tube as claimed in claim 2 wherein:

said correction lens is made of an optical plastic material formed by a one body type mold; and said fluorescent dot patterns are exposed by employing said correction lens.

9. A color display apparatus equipped with the color cathode-ray tube according to claim 1 wherein:

when the fluorescent dot patterns are irradiated by the electron beams so as to emit light therefrom, the landing error of the electron beams onto said fluorescent dot patterns is smaller than, or equal to 20 $\mu$m.

10. A method for manufacturing a color cathode-ray tube wherein:

while swinging a correction lens formed in such a manner that a level distance is made smaller than, or equal to 5 $\mu$m, which is constituted by a plurality of flat planes, or a plurality of curved planes, and is defined between said flat planes, or said curved planes located adjacent to each other, exposing light which has passed said correction lens is irradiated onto a photo-sensitive film formed on an inner surface of a face panel of the color cathode-tube via a shadow mask so as to expose said photosensitive film; and while using said exposed photosensitive film as a mask, fluorescent dot patterns are formed on a surface of the face panel, whereby a screen is constituted by more than 1,000,000 pixels of said fluorescent dot patterns having a dot pitch smaller than or equal to 0.3 $\mu$m, and a landing error onto said fluorescent dot patterns is lower than, or equal to 20 $\mu$m.

11. A method for manufacturing a color cathode-ray tube as claimed in claim 10 wherein:

said correction lens owns a plane for forming said level difference which is formed in parallel to a light incident direction of said exposing light to said correction lens; and said photosensitive film is exposed by employing said correction lens.

12. A method for manufacturing a color cathode-ray tube as claimed in claim 10 wherein:

said correction lens owns a plane for forming said level difference which is inclined at an angle smaller than, or equal to 120 degrees with respect to a reference plane of said correction lens; and said photosensitive film is exposed by employing said correction lens.

13. A method for manufacturing a color cathode-ray tube as claimed in claim 10 wherein:

said correction lens owns a region for reducing light transmissivity of said exposing light, which is formed with a uniform width on a plane from which said exposing light is projected; and said photosensitive film is exposed by employing said correction lens.

14. A method for manufacturing a color cathode-ray tube as claimed in claim 10 wherein:

said correction lens owns a plane for forming said level difference equipped with very small concaves and convexes, which is inclined at an angle smaller than, or equal to 120 degrees with respect to a reference plane of said correction lens; and said photosensitive film is exposed by using said correction lens.

15. A method for manufacturing a color cathode-ray tube as claimed in claim 10 wherein:

said correction lens is made of an optical plastic material formed by a one body type mold; and said photosensitive film is exposed by employing said correction lens.

16. A method for manufacturing a color cathode-ray tube wherein:

while swinging a correction lens constituted by a plurality of flat planes, or a plurality of curved planes, for uniformly producing widths and contract of latticed light/dark lines, or of dark line patterns over an entire exposing surface, which are caused by said plurality of flat planes or curved planes during exposing operation, exposing light is irradiated onto said correction lens; said exposing light which has passed said correction lens is irradiated onto a shadow mask arranged over an entire surface of a face panel of the color cathode-ray tube; a photosensitive film on said face panel is exposed by said exposing light which has passed said shadow mask; and fluorescent dot patterns are formed on said face panel; whereby a screen is constituted by more than 1,000,000 pixels of said fluorescent dot patterns with a dot pitch smaller than or equal to 0.3 $\mu$m, and a landing error onto said fluorescent dot patterns is lower than, or equal to 20 $\mu$m.

17. A method for manufacturing a color cathode-ray tube as claimed in claim 16 wherein:

said correction lens owns a plane for forming said level difference which is formed in parallel to a light incident direction of said exposing light to said correction lens; and said photosensitive film is exposed by employing said correction lens.

18. A method for manufacturing a color cathode-ray tube as claimed in claim 16 wherein:

said correction lens owns a plane for forming said level difference which is inclined at an angle smaller than, or equal to 120 degrees with respect to a reference plane of said correction lens; and said photosensitive film is exposed by employing said correction lens.

19. A method for manufacturing a color cathode-ray tube as claimed in claim 16 wherein:

said correction lens owns a region for reducing light transmissivity of said exposing light, which is formed with a uniform width on a plane from which said exposing light is projected; and said photosensitive film is exposed by employing said correction lens.

20. A method for manufacturing a color cathode-ray tube as claimed in claim 16 wherein:

said correction lens owns a plane for forming said level difference equipped with very small concaves and convexes, which is inclined at an angle smaller than, or equal to 120 degrees with respect to a reference plane of said correction lens; and said photosensitive film is exposed by using said correction lens.

21. A method of manufacturing a color cathode-ray tube comprising the steps of exposing fluorescent dot patterns on a face panel of the color cathode-ray tube via a shadow mask while swinging at least one axis of a correction lens constituted by a plurality of flat planes or a plurality of curved planes along X-axis and Y-axis directions, the correction lens being formed in such a manner that a level difference between the flat planes or the curved planes which constitute the correction lens and which are located adjacent to each other is smaller than or equal to 5 $\mu$m, and forming more than 1,000,000 pieces of fluorescent dot patterns having a dot pitch smaller than or equal to 3 mm on the face panel so that when the fluorescent dot patterns are irradiated by electron beams, a landing error of the electron beams onto the fluorescent dot patterns is smaller than or equal to 20 $\mu$m.

22. A color display apparatus wherein, a color cathode-ray tube is provided with more than 1,000,000 pixels of fluorescent dot patterns, a dot pitch of which is smaller than or equal to 0.3 mm, and a landing error of said electron beams onto the fluorescent dot patterns is smaller than or equal to 20 $\mu$m when the fluorescent dot patterns are irradiated by electron beams.

* * * * *